US012214935B2

(12) United States Patent
Falzoni et al.

(10) Patent No.: US 12,214,935 B2
(45) Date of Patent: Feb. 4, 2025

(54) CAP FOR CLOSING A CONTAINER, A COMBINATION OF A CAP AND A NECK

(71) Applicant: SACMI COOPERATIVA MECCANICI IMOLA SOCIETA' COOPERATIVA, Imola (IT)

(72) Inventors: Alessandro Falzoni, imola (IT); Vittorio Bassi, Faenza (IT)

(73) Assignee: SACMI COOPERATIVA MECCANICI IMOLA SOCIETA'COOPERATIVA, Imola (IT)

( * ) Notice: Subject to any disclaimer, the term of this patent is extended or adjusted under 35 U.S.C. 154(b) by 305 days.

(21) Appl. No.: 17/597,551

(22) PCT Filed: Jul. 16, 2020

(86) PCT No.: PCT/IB2020/056683
§ 371 (c)(1),
(2) Date: Jan. 11, 2022

(87) PCT Pub. No.: WO2021/014287
PCT Pub. Date: Jan. 28, 2021

(65) Prior Publication Data

US 2022/0258925 A1 Aug. 18, 2022

(30) Foreign Application Priority Data

Jul. 22, 2019 (IT) ..... 102019000012534
Jan. 30, 2020 (WO) ..... PCT/IB2020/050748

(51) Int. Cl.
*B65D 41/34* (2006.01)
*B65D 1/02* (2006.01)
*B65D 55/16* (2006.01)

(52) U.S. Cl.
CPC ..... *B65D 41/3428* (2013.01); *B65D 1/0246* (2013.01); *B65D 55/16* (2013.01); *B65D 2401/30* (2020.05)

(58) Field of Classification Search
CPC . B65D 41/3428; B65D 2401/30; B65D 1/024
See application file for complete search history.

(56) References Cited

U.S. PATENT DOCUMENTS 5,246,125 A 9/1993 Julian
5,360,126 A 11/1994 Snyder et al.
(Continued)

FOREIGN PATENT DOCUMENTS

CN 1631740 A 6/2005
CN 101400578 A 4/2009
(Continued)

OTHER PUBLICATIONS

Third Party Observations According to Art. 115EPC, EP3917852, Oct. 9, 2023, 3 pages.
(Continued)

*Primary Examiner* — Jeffrey R Allen
(74) *Attorney, Agent, or Firm* — Chrisman Gallo Tochtrop LLC

(57) ABSTRACT

A cap for a container comprises a side wall extending about an axis and a transversal wall arranged at an end of the side wall.

A separation line is provided on the side wall for defining:
- a retaining ring intended to remain anchored to a neck of the container, and
- a closure element which can removably engage the neck, so as to open or close the container.

The separation line extends about the axis and is circumferentially interrupted so as to leave a joining portion between the retaining ring and the closing element.
(Continued)

The cap further has an incision line which extends transversally to the axis between the separation line and a free edge of the retaining ring, so that between the separation line and the incision line two connecting bands are defined, the connecting bands joining the retaining ring to the joining portion. The connecting bands have a radial thickness measured in a radial direction and a height measured parallel to the axis. The ratio between the height and the radial thickness of the connecting bands is greater than, or equal to, 1.4 and is less than, or equal to, 6.5.

13 Claims, 9 Drawing Sheets

(56) References Cited

U.S. PATENT DOCUMENTS

| | | | | |
|---|---|---|---|---|
| 6,474,491 | B1 | 11/2002 | Benoit-Gonin et al. | |
| 6,523,710 | B1 | 2/2003 | Hidding et al. | |
| 8,123,056 | B2 | 2/2012 | Falzoni | |
| 10,981,700 | B2 | 4/2021 | Migas et al. | |
| 2005/0173368 | A1 | 8/2005 | Nusbaum et al. | |
| 2009/0152229 | A1 | 6/2009 | Falzoni | |
| 2011/0114593 | A1 | 5/2011 | Ishii et al. | |
| 2012/0024815 | A1 | 2/2012 | Kwon | |
| 2012/0285921 | A1 | 11/2012 | Kwon | |
| 2016/0288961 | A1 | 10/2016 | Maguire | |
| 2017/0203896 | A1 | 7/2017 | Maguire | |
| 2017/0362003 | A1 | 12/2017 | Maguire | |
| 2018/0079570 | A1 | 3/2018 | Maguire | |
| 2020/0115115 | A1* | 4/2020 | Migas | B65D 55/16 |
| 2020/0207525 | A1 | 7/2020 | Sung | |
| 2020/0283201 | A1 | 9/2020 | Migas et al. | |
| 2022/0002021 | A1 | 1/2022 | Krautkramer | |
| 2022/0166873 | A1 | 5/2022 | Chan | |
| 2023/0090849 | A1 | 3/2023 | Krautkramer | |

FOREIGN PATENT DOCUMENTS

| | | | |
|---|---|---|---|
| CN | 112996733 | A | 6/2021 |
| CN | 113015683 | A1 | 6/2021 |
| EP | 1529736 | A2 | 5/2005 |
| JP | 2010083488 | A | 4/2010 |
| JP | 2011213372 | A | 10/2011 |
| JP | 2012201380 | A | 10/2012 |
| JP | 2014031202 | A | 2/2014 |
| KR | 100981240 | B1 | 9/2010 |
| WO | 02062674 | A1 | 8/2002 |
| WO | 2016182305 | A1 | 11/2016 |
| WO | 2019031779 | A1 | 2/2019 |
| WO | 2020050823 | A1 | 3/2020 |
| WO | 2020093058 | A2 | 5/2020 |
| WO | 2020099200 | A1 | 5/2020 |

OTHER PUBLICATIONS

Chinese Search Report, issued in CN 310401, Mar. 18, 2024, 3 pages.

First Review Opinion Notice (with English Translation), issued in CN App. No. 2020800527244, Mar. 20, 2024, 21 pages.

EP Third Party Observations, issued in EP App. No. 4023564, May 22, 2023, 7 pages.

EP Third Party Observations, issued on Jun. 6, 2022 in EP App. No. 3976488, 81 pages.

English translation of Chinese Office action issued in CN Pub. No. 202080023617.9 on Aug. 12, 2022, 8 pages.

Chinese Office action (with English translation), issued in CN App. No. 100098, Aug. 12, 2022, 26 pages.

Corvaglia, "Closure for Container and Method for Operating Said Closure", Jun. 2019, 73 pages.

* cited by examiner

Fig.1
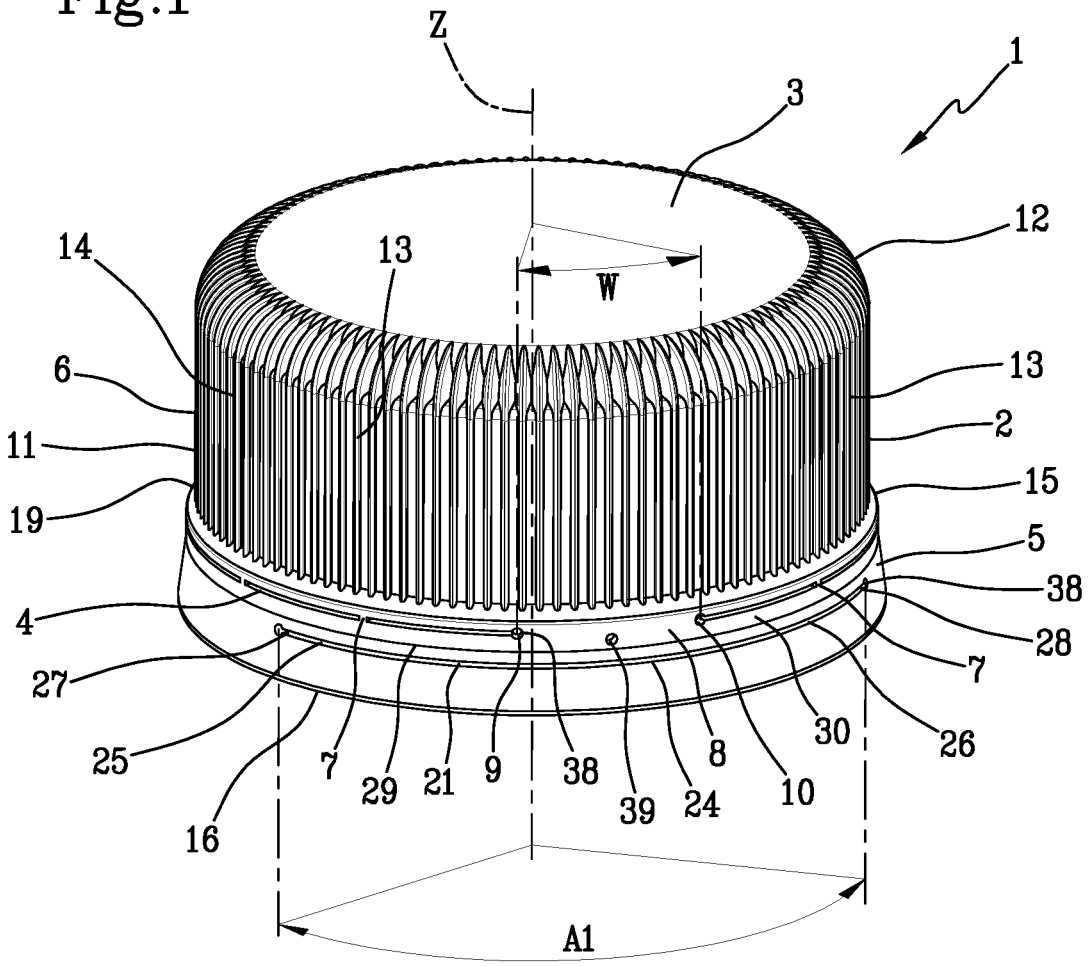
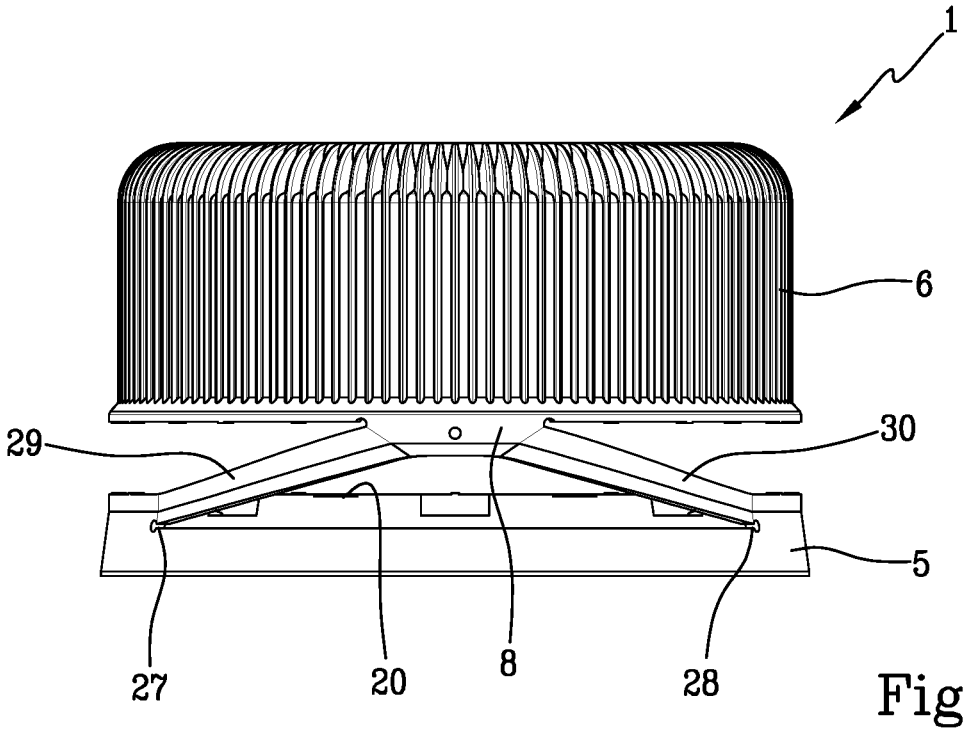
Fig.2

Fig.4
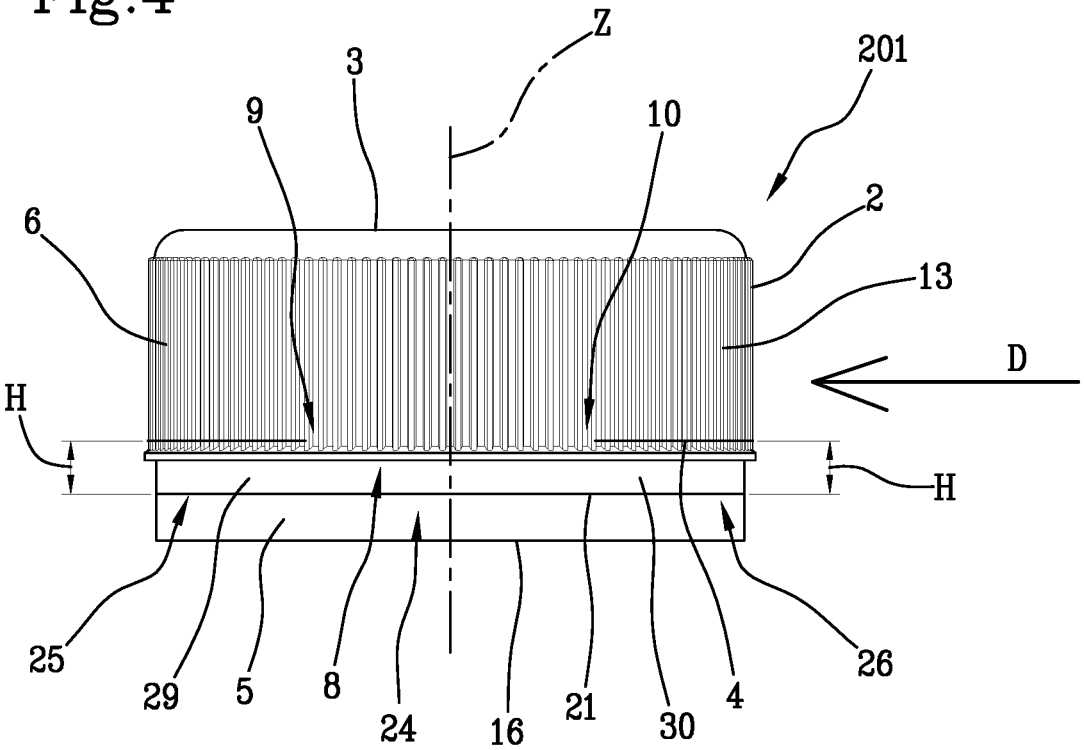
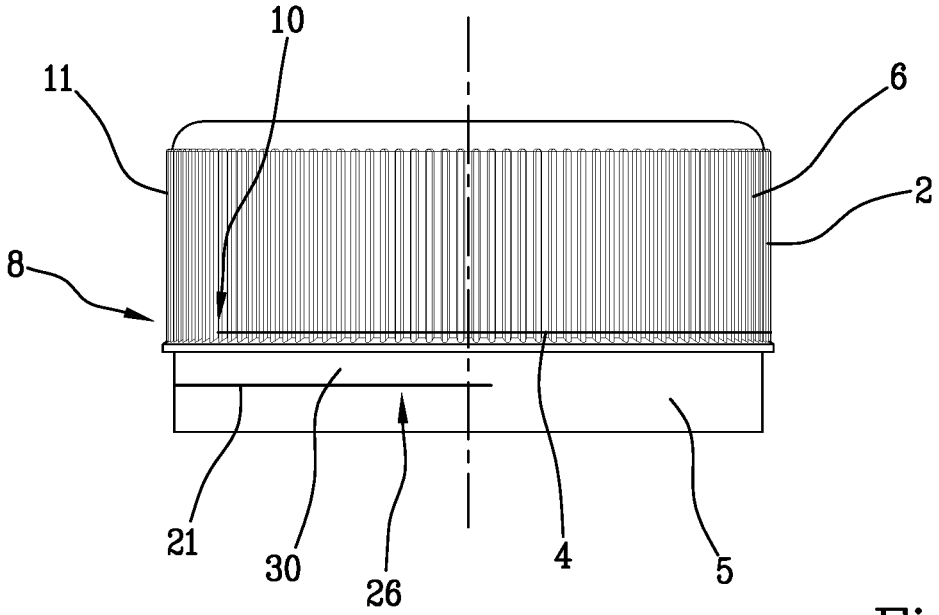
Fig.5

Fig.7
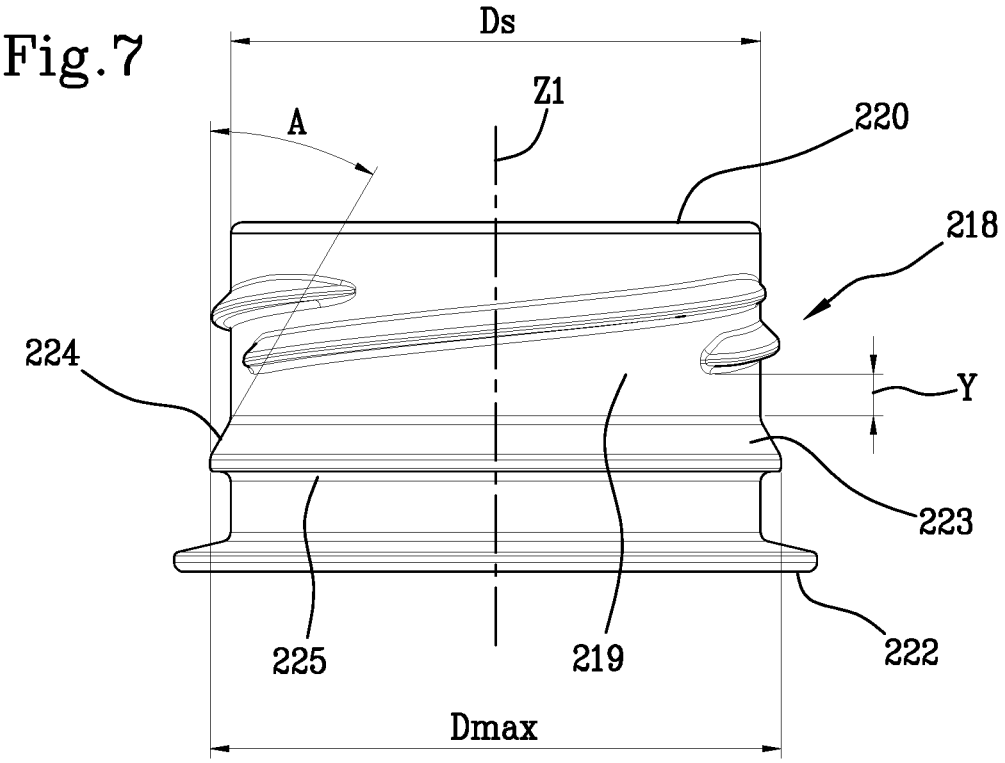
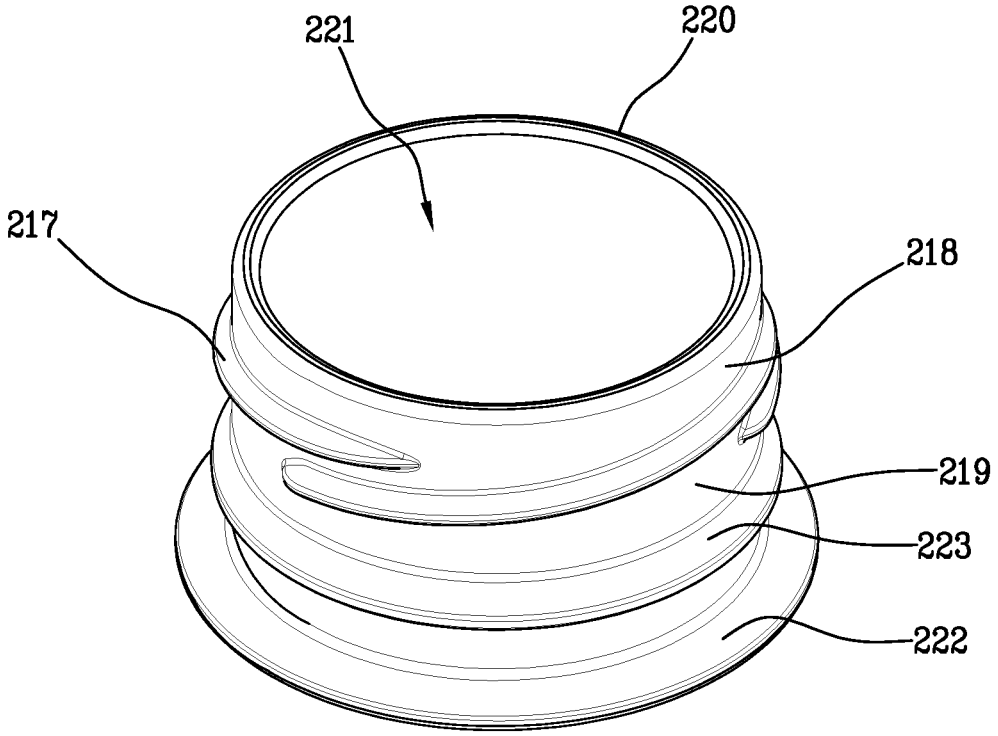
Fig.8

Fig.10
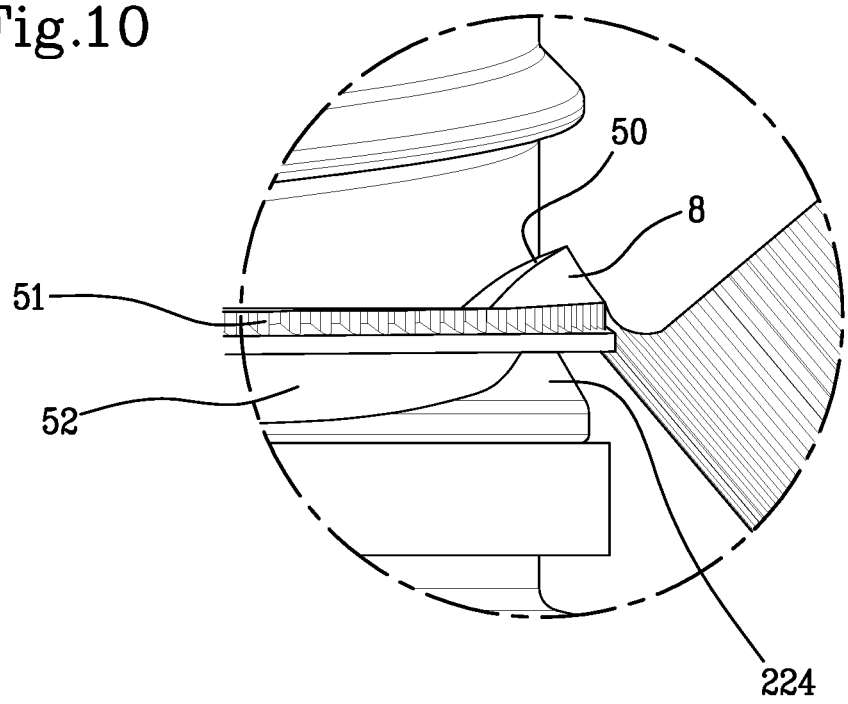
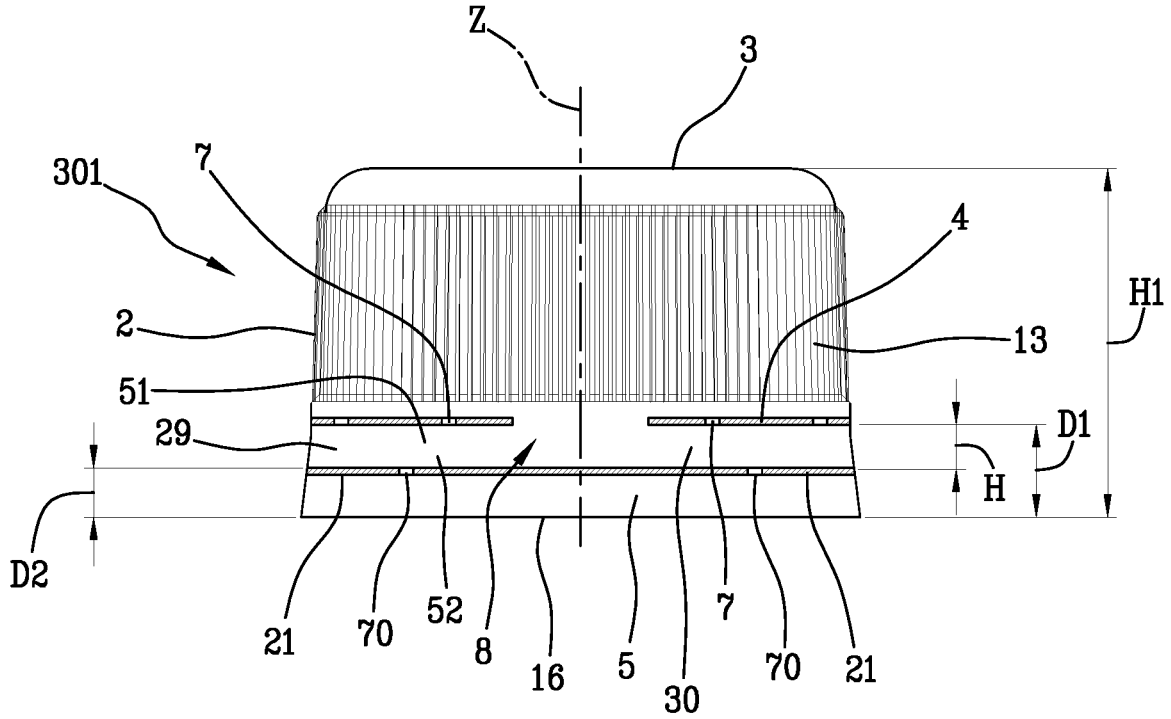
Fig.11

CAP FOR CLOSING A CONTAINER, A COMBINATION OF A CAP AND A NECK

This invention relates to a cap for a container, in particular a cap having a retaining ring, which can be associated with a neck of the container, the cap further having a closure element which, after opening, remains connected to the retaining ring. The cap according to the invention is particularly, but not exclusively, suitable for being applied to bottles intended to contain liquid substances.

The invention further relates to a combination of a cap and of a neck of a container.

In addition, the invention relates to a method for the production of a cap for a container.

Caps for bottles are known, which comprise a cup-shaped body provided with an inner thread suitable for engaging with an outer thread of a neck of the bottle. The known caps are further provided with a tamper-evident ring connected to the cup-shaped body by a plurality of breakable elements. When the cap is opened for the first time, the cup-shaped body separates from the tamper-evident ring due to breakage of the breakable elements. The tamper-evident ring remains associated with the neck of the bottle, whilst the cup-shaped body can be unscrewed by the user, which in this way separates the cup-shaped body from the bottle to access the contents of the bottle. Subsequently, the cup-shaped body can be screwed again on the neck to reclose the bottle.

Sometimes, after the bottle has been emptied, the user throws the cup-shaped body on the ground, either intentionally or accidentally, whilst the bottle, together with tamper-evident ring associated thereto, is correctly disposed of in a waste bin.

To overcome this drawback, caps have been proposed which are provided with a retaining ring, which can be associated with a neck of a bottle, and a closure element, connected to the retaining ring by a hinge. The closure element can be rotated about the hinge between an open position, in which a user can access the contents of the bottle, and a closed position, in which the closure element prevents access to the bottle. The hinge keeps the closure element associated with the retaining ring and, therefore, with the bottle, thereby preventing the closure element from being thrown on the ground independently of the bottle.

The known caps provided with a hinge have however the drawback of being rather complicated to be manufactured. In effect, the hinge is usually produced in the same mould in which the cap is obtained, particularly by injection moulding or compression moulding.

In order to produce the caps with a hinge of known type it is therefore necessary to provide special moulds, different from those which are normally adopted for producing the caps free of the hinge. These moulds are more complicated than the ordinary ones, in particular because the caps with hinge of known type may have undercut parts, which thus require special means in order to be extracted from the mould.

Moreover, the caps with a hinge of known type may have zones with a very reduced thickness, which are difficult to obtain because the molten polymeric material flows with difficulty in the portions of the mould intended to form these zones.

This increases the costs for the production of the caps with hinge and/or the cycle time necessary to obtain them.

In caps with a hinge of the known type, sometimes the closure element, after having been moved to the open position, prematurely recloses by rotating about the hinge. It may also happen that the closure element partly rotates about the hinge, thereby moving into a vertical, or almost vertical configuration. In these cases, the closure element may in an unwelcome way strike the face of a user, who is drinking from the bottle to which the cap with hinge is applied, or be interposed in the desired way between the bottle and a container, for example a glass, into which a liquid contained in the bottle is poured.

Moreover, in caps with a hinge of the known type, when the closure element has been moved to the open position, the retaining ring, which remained associated with the neck, is free to rotate about the neck itself. Therefore, it may happen that, whilst a user is drinking a liquid contained in the bottle to which the cap with a hinge is applied, or is pouring the liquid contained in the bottle into a glass, the retaining ring rotates about the neck due to the force of gravity, together with the closure element. If that occurs, the closure element may strike the face of the user who is drinking, or be interposed between the neck of the bottle and the glass, which obstructs the dispensing of the liquid into the glass.

An object of the invention is to improve the caps of known type, particularly the caps comprising a retaining ring intended to remain associated with a neck of the container and a closure element which may removably engage with the neck to allow a user to open or alternatively close the container.

Another object is to provide a cap for a container, of the type mentioned above, which can be produced simply.

A further object is to provide a cap for a container, provided with a closure element that remains connected to the retaining ring which does not require very complicated moulds for its production.

A further object is to provide a cap for a container, comprising a closure element that remains connected to the retaining ring, wherein the closure element is kept stably in an open position.

Another object is to provide a cap for a container wherein, in the open position, there is reduced risk of the closure element accidentally striking the face of the user or obstructing the dispensing of a substance contained in the container into a glass or the like.

In a first aspect of the invention, there is provided a combination of a cap for a container and of a neck of a container,

- wherein the neck is delimited by an outer surface from which a circular enlargement projects, the outer surface extending up to a rim of the neck, and wherein the cap comprises a side wall extending about an axis, a separation line being provided on the side wall for defining:
  - a retaining ring intended to engage with the circular enlargement to remain anchored to the neck,
  - and a closure element which can removably engage the neck so as to be movable between a closed position and an open position,
- wherein the separation line extends about the axis and is circumferentially interrupted so as to leave a joining portion between the retaining ring and the closure element,
- wherein the cap further has an incision line which extends transversally to the axis between the separation line and a free edge of the retaining ring, so that two connecting bands are defined between the separation line and the incision line, the two connecting bands joining the retaining ring to the joining portion,
- and wherein the connecting bands are deformable to allow the joining portion to rotate when the closure element is moved from the closed position to the open position, so that an edge of the joining portion which, in the closed position, faces the retaining ring, is facing towards the rim of the neck in the open position.

Owing to this aspect of the invention, it is possible to obtain a cap capable of stably remaining in the open position. In effect, when the joining portion rotates whilst the closure element passes from the closed position to the open position, interference occurs between the joining portion and the neck of the container. This interference persists even in the open position. In order to bring the closure element back to the closed position, a predetermined force has to be applied to the closure element, so as to overcome the interference between the neck and the joining portion. This makes it difficult, if not impossible, for the closure element to return to the closed position on its own.

In more detail, in the open position, the joining portion rests on the neck of container and the connecting bands, which have been deformed, apply on the joining portion a force which tends to keep the joining portion in contact with the neck of the container. That causes the interference between the joining portion and the neck of the container, which stably keeps the closure element in the open position.

Owing to the interference between the joining portion and the neck, rotation of the cap, in particular of the retaining ring, about the neck, is also obstructed.

In an embodiment, the connecting bands are deformable by a twisting movement when the closure element is moved from the closed position to the open position.

This twisting movement may affect at least one part of the height of each connecting band, the height being defined as the dimension of the connecting band in a direction parallel to the axis, in the closed position of the closure element.

This makes is possible to rotate the joining portion as previously described, without providing fracture or weakening lines placed between the joining portion and the connecting bands. Consequently production of the cap is facilitated.

Whilst the joining portion rotates and its edge slides in contact with the neck until it reaches the open position in which the edge of the joining portion is facing towards the rim of the neck, an interference is generated between the joining portion and the neck, which reaches a maximum value when the joining portion is substantially perpendicular to the neck, and which is reduced (but without reaching a null value) after the joining portion has overturned and is resting on the neck with the edge facing upwards.

The user who moves the closure element towards the open position notices that the position in which the interference is at its maximum has been passed, since his/her hand perceives a sort of vibration which makes he/she understand that the closure element has been stably moved to the open position. That is welcomed by the user, who has the certainty of having correctly opened the container.

in a second aspect of the invention, there is provided a combination of a cap for a container and a neck of a container, wherein the neck is delimited by an outer surface from which a circular enlargement projects, the outer surface extending up to a rim of the neck, the rim facing upwards in an operative condition, and wherein the cap comprises a side wall extending about an axis, a separation line being provided on the side wall for defining:

- a retaining ring intended to engage with the circular enlargement to remain anchored to the neck,
- and a closure element which can removably engage the neck so as to be movable between a closed position and an open position, wherein the separation line extends about the axis and is circumferentially interrupted so as to leave a joining portion between the retaining ring and the closure element, the cap further having an incision line which extends transversally to the axis between the separation line and a free edge of the retaining ring, so that two connecting bands are defined between the separation line and the incision line, the two connecting bands joining the retaining ring to the joining portion, the connecting bands being deformable by a twisting movement which affects at least one part of the height of each connecting band, so that the joining portion rotates relative to the connecting bands when the closure element is moved from the closed position to the open position, and an edge of the joining portion which, in the closed position, faces the retaining ring, is positioned at least in a central part thereof above the circular enlargement, an interference between the joining portion and the neck being thereby generated which keeps the closure element in the open position.

Owing to the second aspect of the invention, it is possible to prevent the closure element from returning prematurely to the closed position. Moreover, the interference between the joining portion and the neck, and possibly also between the connecting bands and the neck, prevents the retaining ring from rotating freely around the neck when the cap is open, together with the closure element connected thereto.

In a third aspect of the invention, there is provided a combination of a cap for a container and a neck of a container, wherein the neck is delimited by an outer surface from which a circular enlargement projects, the outer surface extending up to a rim of the neck, and wherein the cap comprises a side wall extending about an axis, a separation line being provided on the side wall for defining:

- a retaining ring intended to engage with the circular enlargement to remain anchored to the neck,
- and a closure element which can removably engage the neck so as to be movable between a closed position and an open position, wherein the separation line extends about the axis and is circumferentially interrupted so as to leave a joining portion between the retaining ring and the closure element, the cap further having an incision line which extends transversally to the axis between the separation line and a free edge of the retaining ring, so that between the separation line and the incision line two connecting bands are defined, the connecting bands joining the retaining ring to the joining portion, wherein each connecting band comprises a first portion adjacent to the separation line and a second portion adjacent to the incision line, the first portion being configured to expand radially so that the second portion twists thereby passing under the first portion when the closure element is moved from the closed position to the open position.

The deformation of the connecting bands in the third aspect of the invention generates an interference between the joining portion and the neck of the container, which makes it possible to stably keep the closure element in the open position.

In an embodiment of the previous aspects of the invention, the distance between the separation line and the incision line is equal to, or greater than, 0.8 times half the difference between the external diameter of the circular enlargement and the diameter of the outer surface of the neck, immediately above the circular enlargement.

More specifically, the distance between the separation line and the incision line is equal to, or greater than, 1.5 times half the difference between the external diameter of the circular enlargement and the diameter of the outer surface of the neck, immediately above the circular enlargement.

The above-mentioned distance is measured parallel to the axis of the side wall, when the closure element is in the closed position. This distance therefore corresponds to the height of the connecting bands.

Experimentation has shown that the values of the distance between the separation line and the incision line mentioned above guarantee that the connecting bands deform correctly when the closure element passes from the closed position to the open position. In particular, if the distance between the separation line and the incision line satisfies the condition indicated above, a condition of interference between the joining portion and the neck occurs which is very favourable for keeping the closure element in the open position.

It is preferable for said distance between the separation line and the incision line to be equal to, or greater than, 2 times half the difference between the external diameter of the circular enlargement and the diameter of the outer surface of the neck, immediately above the circular enlargement.

It is even more preferable for said distance between the separation line and the incision line to be equal to, or greater than, 2.5 times half the difference between the external diameter of the circular enlargement and the diameter of the outer surface of the neck, immediately above the circular enlargement.

In a fourth aspect of the invention, there is provided a combination of a cap for a container and of a neck of a container, wherein the neck is delimited by an outer surface from which a circular enlargement projects, the outer surface extending up to a rim of the neck, and wherein the cap comprises a side wall extending about an axis, a separation line being provided on the side wall for defining:

a retaining ring intended to engage with the circular enlargement to remain anchored to the neck, and a closure element which can removably engage the neck so as to be movable between a closed position and an open position, wherein the separation line extends about the axis and is circumferentially interrupted so as to leave a joining portion between the retaining ring and the closure element, the cap further having an incision line which extends transversally to the axis between the separation line and a free edge of the retaining ring, so that two connecting bands are defined between the separation line and the incision line, the two connecting bands joining the retaining ring to the joining portion, and wherein a distance between the separation line and the incision line is equal to, or greater than, 0.8 times half the difference between an external diameter of the circular enlargement and a diameter of the outer surface of the neck immediately above the circular enlargement, said distance being preferably equal to, or greater than, 1.5 times half of said difference.

In the combination according to the fourth aspect of the invention, there is an interference condition between the joining portion and the neck which is very favourable for keeping the closure element in the open position.

In an embodiment of the previous aspects of the invention, the joining portion has an angular dimension about the axis of the side wall, greater than, or equal to, 20°, preferably greater than, or equal to, 25°.

In an embodiment of the previous aspects of the invention, the joining portion has an angular dimension about the axis of the side wall which is less than, or equal to, 120°, preferably less than, or equal to, 90°.

In this way, the joining portion is not too wide about the axis of the side wall, which would make it difficult for the joining portion to overturn, that is to say for its edge to pass from a configuration facing the retaining ring, to a configuration facing towards the rim of the neck.

At the same time, the joining portion is not too narrow about the axis of the side wall, which could generate an interference, between the joining portion and the neck, which is not sufficient to keep the closure element stably in the open position.

In an embodiment of the previous aspects of the invention, the neck is provided with at least one fixing element suitable for engaging with the closure element to allow the closure element to be removably fixed to the neck.

The at least one fixing element may comprise a thread having one or more starts.

Preferably but not necessarily, the distance between the circular enlargement and the at least one fixing element is greater than, or equal to, half of the distance between the separation line and the incision line.

In this way, between the circular enlargement and the at least one fixing element there is a space sufficient for receiving the joining portion, without the edge of the latter interfering with the at least one fixing element.

In an embodiment of the previous aspects of the invention, the circular enlargement is delimited, towards the rim of the neck, by a truncated cone shaped surface.

In an embodiment of the previous aspects of the invention, a generatrix of the truncated cone shaped surface forms an angle less than, or equal to, 35° with a straight line parallel to a longitudinal axis of the neck.

Preferably, the above-mentioned angle is 30°.

In this way, the closure element can easily be positioned in an open position in which it forms a sufficiently large opening angle with the neck.

In an embodiment of the previous aspects of the invention, the separation line extends in a portion of the side wall in which a plurality of knurling lines is provided.

That is to say, the separation line intersects the knurling lines provided on the side wall of the cap.

That allows maximization of the height of the connecting bands, without compromising the capacity to grip the cap by a user or a capping machine. Alternatively, the separation line may extend in a portion of the side wall externally delimited by a smooth surface, that is to say, a surface free of knurling lines.

In a fifth aspect of the invention, there is provided a cap for a container, comprising a side wall extending about an axis and a transversal wall arranged at an end of the side wall, a separation line being provided on the side wall for defining:

a retaining ring intended to remain anchored to a neck of the container, and a closure element which can removably engage the neck, so as to open or close the container;

wherein the separation line extends about the axis and is circumferentially interrupted so as to leave a joining portion between the retaining ring and the closure element, the cap further having an incision line which extends transversally to the axis between the separation line and a free edge of the retaining ring, so that two connecting bands are defined between the separation line and the incision line, the two connecting bands joining the retaining ring to the opposite end zones of the joining portion.

The joining portion makes it possible to keep the closure element stably associated with the retaining ring and therefore with the neck of the container. This prevents the closure element from being thrown on the ground separately from the container. This thus increases the probability that the closure element, together with the container, is correctly disposed of together with waste of the same type, in particular together with plastic material waste.

The cap according to the fifth aspect of the invention may be produced in a relatively simple manner, without the need to use special moulds. In effect, the cap according to the fifth aspect of the invention can be produced in a traditional mould, if the incision line is made by a cutting operation. It is possible by the cutting operation to obtain an incision line passing through the entire thickness of the side wall, or an incision line which does not pass through, at which the thickness of the side wall is cut only partially.

It is also possible to produce the incision line by moulding, inside the mould in which the cap is produced, but without, however, causing excessive complications of the mould, owing to the particularly simple shape of the incision line. In this case, the incision line may even be shaped as a weakening line.

Since the incision line lies between the separation line and the free edge of the retaining ring, the incision line does not weaken the joining portion. In the cap according to the invention, the joining portion is therefore relatively sturdy, which makes it more difficult to accidentally separate the retaining ring from the closure element.

The connecting bands, together with the joining portion, define a hinge arrangement which has a capacity for movement, in an axial direction, noticeably greater than the capacity for movement which would be allowed by the joining portion alone.

In effect, that hinge arrangement makes it possible to move the closure element away from the retaining ring along a significant axial distance, determined by the combination of the length of the connecting bands and of the joining portion. In this way the closure element can be easily disengaged from the neck of the container.

In an embodiment, the joining portion has an angular dimension about the axis of the side wall, greater than, or equal to, 20°, preferably greater than, or equal to, 25°.

In an embodiment, the joining portion has an angular dimension about the axis of the side wall which is less than, or equal to, 120°, preferably less than, or equal to, 90°.

That allows the joining portion to rotate when the closure element is moved from a closed position to an open position, so that an edge of the joining portion which, in the closed position, faces the retaining ring, is facing towards a rim of the neck in the open position. In this way it is possible to obtain the advantages previously described with reference to the first aspect of the invention, in particular relative to the closure element which is stably kept in the open position.

In an embodiment, the connecting bands may be arranged symmetrically to each other relative to a plane containing the axis of the side wall and a centre line of the joining portion.

This symmetrical shape allows a reduction in the involuntary movements of the closure element when the cap is in an open position, in particular limiting its lateral movements.

In an embodiment, the joining portion has a thickness substantially constant on a plane containing the separation line.

That makes the cap according to the fifth aspect of the invention even simpler to make, since special moulds are not necessary for producing triangular hinges or very thin joining lines.

In a sixth aspect of the invention, there is provided a cap for a container, comprising a side wall extending about an axis and a transversal wall arranged at an end of the side wall, a separation line being provided on the side wall for defining:

- a retaining ring intended to remain anchored to a neck of the container, and
- a closure element which can removably engage the neck, so as to open or close the container;

wherein the separation line extends about the axis and is circumferentially interrupted so as to leave a joining portion between the retaining ring and the closure element, the cap further having an incision line which extends transversally to the axis between the separation line and a free edge of the retaining ring, so that two connecting bands are defined between the separation line and the incision line, the connecting bands joining the retaining ring to the joining portion, the connecting bands having a radial thickness measured in a radial direction relative to the axis, the connecting bans further having a height measured parallel to the axis, and wherein the ratio between the height and the radial thickness of the connecting bands is greater than, or equal to, 1.4, said ratio being less than, or equal to, 6.5. These values of the ratio between the height and the radial thickness of the connecting bands ensure that the connecting bands have an optimum torsional rigidity to undergo a twisting movement which is such that the joining portion rotates relative to the connecting bands and rests on the neck above the circular enlargement. An interference is thus generated between the neck and the joining portion, said interference being sufficient to keep the closure element in an open position in a reliable and secure manner.

In a seventh aspect of the invention, there is provided a cap for a container, comprising a side wall extending about an axis and a transversal wall arranged at an end of the side wall, a separation line being provided on the side wall for defining:

- a retaining ring intended to remain anchored to a neck of the container, and
- a closure element which can removably engage the neck, so as to open or close the container;

wherein the separation line extends about the axis and is circumferentially interrupted so as to leave a joining portion between the retaining ring and the closure element, the cap further having an incision line which extends transversally to the axis between the separation line and a free edge of the retaining ring, so that two connecting bands are defined between the separation line and the incision line, the connecting bands joining the retaining ring to the joining portion, the incision line and the separation line being cut lines, wherein along the separation line a plurality of breakable bridges is provided, along the incision line a plurality of breakable elements being provided, the breakable bridges and the breakable elements being intended to break the first time the cap is opened, wherein the incision line comprises a peripheral part, a further peripheral part and a central part interposed between the peripheral part and the further peripheral part, and wherein the incision line lies on a plane arranged perpendicularly to said axis.

In an eighth aspect of the invention, there is provided a method comprising the steps of:

producing a cap for a container, the cap comprising a side wall extending about an axis and a transversal wall arranged at an end of the side wall, providing a separation line on the side wall for defining a retaining ring intended to remain anchored to a neck of the container, and a closure element which can removably engage the neck, so as to open or close the container, wherein the separation line extends about the axis and is circumferentially interrupted so as to leave a joining portion between the retaining ring and the closure element, making an incision line which extends transversally to the axis, so that two connecting bands are defined between the separation line and the incision line, the two connecting bands joining the retaining ring to the joining portion.

The method according to the eighth aspect of the invention makes it possible to obtain, in a particularly simple manner, a cap wherein the closure element remains associated with the retaining ring.

In an embodiment, the separation line and the incision line are made by cutting.

The invention can be better understood and implemented with reference to the accompanying drawings which illustrate some non-limiting example embodiments of it and in which:

FIG. 1 is a perspective view of a cap for a container, in a closed position;

FIG. 2 is a side view of the cap of FIG. 1, in a configuration wherein a closure element of the cap is separated from a retaining ring;

FIG. 4 is a side view showing a cap for a container, according to an alternative embodiment;

FIG. 5 is a view like that of FIG. 4, from the direction D indicated in FIG. 4;

FIG. 7 is a side view of a neck on which the cap of FIG. 4 may be screwed;

FIG. 8 is a perspective view of the neck of FIG. 7;

FIG. 10 shows an enlarged detail like that of FIG. 9, highlighting a different behaviour of the cap;

FIG. 11 is a view like that of FIG. 4, showing a cap according to an alternative embodiment;

Figure 3:
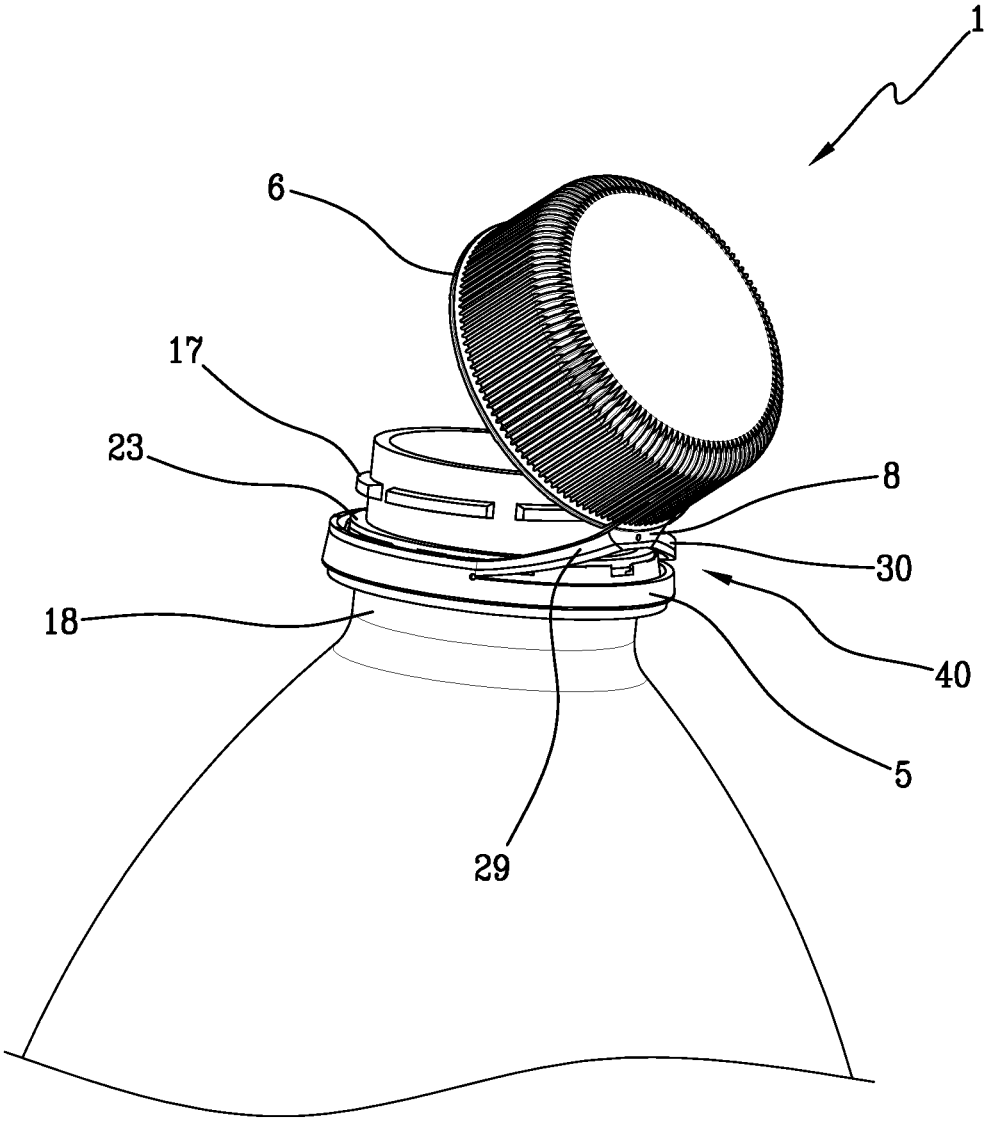
FIG. 3 is a perspective and interrupted view of the cap of FIG. 1, applied on a neck of a container, in a configuration wherein a closure element of the cap is moved to a lateral position relative to the neck.

FIG. 1 shows a cap 1 for closing a container, particularly a bottle intended to contain a liquid substance such as a drink. The cap 1 is made of polymeric material. Any polymeric material suitable for moulding may be used to obtain the cap 1.

The cap 1 is shown in FIG. 1 in a closed position in which the cap 1 is when it leaves a cap production line, ready to be applied on the container. In this condition, the cap 1 comprises a side wall 2 which extends about an axis Z, and a transversal wall 3 arranged at an end of the side wall 2, so as to close that end. The transversal wall 3 extends transversally, in particular perpendicularly, to the axis Z. The transversal wall 3 may be flat, even though other shapes are theoretically possible. In the example illustrated, the transversal wall 3 has a substantially circular shape in plan view.

The cap 1 has a separation line 4, positioned on the side wall 2 and extending about the axis Z. The separation line 4 extends on a plane arranged transversally, in particular perpendicularly, to the axis Z. The separation line 4 defines on the cap 1 a retaining ring 5 and a closure element 6. The latter are positioned on opposite sides of the separation line 4. As described in more detail below, when the cap 1 is brought to an open position, the closure element 6 separates from the retaining ring 5 along the separation line 4.

Along the separation line 4 a plurality of breakable bridges 7 may be provided, which connect the retaining ring 5 to the closure element 6. The breakable bridges 7 are intended to be broken the first time the cap 1 is moved to the open position, to signal that the container is no longer intact. The separation line 4 may be parallel to a free edge 16 of the cap 1. More specifically, the free edge 16 delimits the retaining ring 5 on the opposite side to the transversal wall 3.

The separation line 4 does not extend for an entire angle of 360° about the axis Z. The separation line 4 is interrupted in the circumferential direction, so as to define on the side wall 2 a joining portion 8, at which the closure element 6 remains joined to the retaining ring 5.

In other words, the separation line 4 has a first end 9 and a second end 10. The joining portion 8 is interposed between the first end 9 and the second end 10. At the joining portion 8, the retaining ring 5 is joined to the closure element 6.

As shown in FIG. 1, the joining portion 8 has an angular dimension W about the axis Z.

No arrow shaped hinges or reduced thickness zones are provided in the joining portion 8.

In the example illustrated, the closure element 6 has a cup-shaped body and comprises a skirt 11 which extends about the axis Z. The skirt 11 is connected to the transversal wall 3, arranged at the end of the skirt 11 opposite the separation line 4. In particular, the skirt 11 is connected to the transversal wall 3 by a connecting zone 12, which may be shaped, in cross section, like a bevelled edge or a circular connection zone.

The skirt 11 has, on an inner surface thereof, a member for removably fixing, not shown, by which the closure element 6 can removably engage with the neck 18 of the container. The member for removably fixing may comprise, for example, an inner thread intended to engage with an outer thread 17, shown in FIG. 3, formed on the neck 18.

The skirt 11 can be provided, on an outer surface thereof, with a plurality of knurling lines 13, extending parallel to the axis Z and suitable for facilitating gripping of the cap 1 by the user or by the capping machine which applies the cap 1 on the container to be closed.

The knurling lines 13 may continue also in the connecting zone 12 and/or in the retaining ring 5.

In the example shown, the skirt 11 comprises a cylindrical portion 14 on which the knurling lines 13 are made. The skirt 11 further comprises a wide portion 15 having a diameter larger than the cylindrical portion 14. The wide portion 15 may be delimited by a smooth outside surface, that is to say, it can be free of knurling lines. This condition is not, however, necessary and the knurling lines could also extend on the wide portion 15. Between the cylindrical portion 14 and the wide portion 15 a step 19 may be provided.

The retaining ring 5 extends between the free edge 16 and the separation line 4. The retaining ring 5 may be delimited by a cylindrical or truncated cone shaped outer surface. In the closed position of the cap 1 shown in FIG. 1, the retaining ring 5 is coaxial with the closure element 6.

The retaining ring 5 is provided internally with an engagement element 20, shown in FIG. 2, suitable for engaging with a circular enlargement 23, shown in FIG. 3, which projects from an outer surface of the neck 18. The engagement element 20 is configured to abut against the circular enlargement 23 in order to prevent axial movements of the retaining ring 5, away from the neck 18, when the closure element 6 is removed from the neck 18.

The engagement element 20 may be shaped like an annular element which is bent around the free edge 16 towards the inside of the retaining ring 5. In an alternative embodiment not illustrated, there may be a plurality of engagement elements, shaped like tabs which project from the free edge 16 and are bent towards the inside of the retaining ring 5. Alternatively, the engagement element 20 may be shaped like an enlargement, continuous or interrupted, which from an inner surface of the retaining ring 5 projects towards the axis Z to engage with the circular enlargement 23.

As shown in FIG. 1, the cap 1 has an incision line 21 which extends on the side wall 2 transversally, in particular perpendicularly, to the axis Z. In more detail, the incision line 21 is interposed between the separation line 4 and the free edge 16.

If the cap 1 is positioned in the same orientation which it will have after having been applied to the container, that is to say, with the transversal wall 3 facing upwards, the incision line 21 is arranged below the separation line 4. The incision line 21 is therefore located on the side of the retaining ring 5, relative to the separation line 4.

The joining portion 8 is located on the opposite side of the incision line 21 relative to the retaining ring 5. The incision line 21 therefore delimits the joining portion 8 towards the retaining ring 5.

The incision line 21 has an angular extension A1, measured about the axis Z, greater than the angular distance (also measured about the axis Z) between the first end 9 and the second end 10 of the separation line 4, that is to say, the angular dimension W of the joining portion 8. For example, the angular extension A1 of the incision line 21 may be between 60° and 200°, preferably between 75° and 180°. The angular dimension W of the joining portion 8 about the axis Z, that is to say, the angular distance between the first end 9 and the second end 10 of the separation line 4, may be between 5° and 40°, preferably between 10° and 30°.

In the example illustrated, the joining portion 8 is centred relative to the separation line 21. In other words, the midpoint of the separation line 21 and the centre line of the joining portion 8 are aligned with each other in a direction parallel to the axis Z, that is to say, they lie in a common plane which contains the axis Z. This condition is not however necessary, since even a not perfectly centred positioning of the incision line 21 relative to the joining portion 8 is permitted.

In the example illustrated, the incision line 21 has a flat arched shape. However, other shapes are possible.

The incision line 21 and the separation line 4 may be parallel to each other, even though this condition is not necessary. For example, the incision line 21 and the separation line 4 could be slightly inclined relative to each other. Alternatively, the incision line 21 could comprise a plurality of stretches having different inclinations, not necessarily parallel to each other.

As shown in FIG. 1, the incision line 21 has an end 27 and a further end 28. The end 27 extends outside the joining portion 8, beyond the first end 9 of the separation line 4. The further end 28 also extends outside the joining portion 8, but goes beyond the second end 10 of the separation line 4.

The incision line 21 comprises a central part 24 interposed between a peripheral part 25 and a further peripheral part 26. The central part 24 faces the joining portion 8. The peripheral part 25 faces the separation line 4, in particular an end portion of the separation line 4. More precisely, the peripheral part 25 faces the separation line 4 in a zone between the first end 9 of the separation line 4 and the end 27 of the incision line 21. The further peripheral part 26 faces the separation line 4, in particular a further end portion of the separation line 4. More precisely, the further peripheral part 26 faces the separation line 4 in a zone between the second end 10 of the separation line 4 and the further end 28 of the incision line 21.

Between the peripheral part 25 of the incision line 21 and a portion of the separation line 4 which starts from the first end 9, a connecting band 29 is defined for connecting the joining portion 8 to the retaining ring 5. Similarly, between the further peripheral part 26 of the incision line 21 and a further portion of the separation line 4 which starts from the second end 10, a further connecting band 30 is defined for connecting the joining portion 8 to the retaining ring 5

In the example illustrated, the connecting band 29 and the further connecting band 30 are arranged symmetrically to each other relative to a plane containing the axis Z and a centre line of the joining portion 8.

The incision line 21 may be shaped as a through cut which passes through the entire thickness of the side wall 2. Even though this feature is not shown in FIGS. 1 to 3, along the incision line 21 there may be one or more breakable elements intended to break the first time the cap 1 is opened. Alternatively, the incision line 21 may be shaped as a weakening line that does not pass through the entire thickness of the side wall 2, but at which the thickness of the side wall 2 is reduced with respect to the surrounding zones.

At the first end 9 and at the second end 10 of the separation line 4, and/or at the end 27 and at the further end 28 of the incision line 21, there may be incision zones 38, shown in FIG. 1. The incision zones 38 may have a circular geometry and in general have a transversal dimension greater than a width of the corresponding incision line or separation line. This makes it possible to prevent the propagation of fracture cracks starting from the incision or separation lines. In an alternative embodiment, the incision zones 38 may be absent.

In a central part of the joining portion 8 there may be a stress reduction cut 39, having dimensions very limited relative to the dimensions of the joining portion 8, so as to not adversely affect the resistance of the joining portion 8. The stress reduction cut 39 makes it possible to increase the deformability of the central part of the joining portion 8, reducing stresses in the surrounding zones. The presence of the stress reduction cut 39 is optional.

The cap 1 is applied on the neck 18 of the container in the closed position shown in FIG. 1. The cap 1 is positioned in such a way that the engagement element 20 provided inside the retaining ring 5 is below the circular enlargement 23 present on the neck 18.

When the user wishes to open the container for the first time, the user grips the skirt 11 of the closure element 6 and rotates the closure element 6 about the axis Z, in order to unscrew the closure element 6 from the neck 18. Initially, the closure element 6 and the retaining ring 5 are rotated together about the axis Z, and they simultaneously move together in a direction parallel to the axis Z, away from the neck 18. This occurs until the engagement element 20 of the retaining ring 5 abuts against the circular enlargement 23 provided on the neck 18. At this point, the circular enlargement 23 prevents the retaining ring 5 from rising further along the axis Z, acting as a stop for the movement of the retaining ring 5 away from the neck 18.

The closure element 6, which is unscrewed by the user, continues to move along the axis Z away from the neck 18. The breakable bridges 7 are thereby tensioned, until causing their failure. The closure element 6 consequently separates from the retaining ring 5 along the separation line 4, but remains joined to the retaining ring 5 at the joining portion 8.

If the user continues to unscrew the closure element 6, so as to move the closure element 6 along the axis Z to remove it from the neck 18, the first connecting band 29 and the second connecting band 30 deform. In particular, by moving the closure element 6 upwards, the first connecting band 29 and the second connecting band 30 are also pulled upwards. Consequently, the first connecting band 29 and the second connecting band 30 are spaced apart from both the closure element 6 and the retaining ring 5 and remain joined to each other in the joining portion 8.

The first connecting band 29 and the second connecting band 30 thus adopt a kind of trapezium shape as shown in FIG. 2, in which the neck 18 of the container is not shown. In this configuration, the first connecting band 29 remains joined to the retaining ring 5 at the end 27 of the incision line 21. Similarly, the second connecting band 30 remains joined to the retaining ring 5 at the further end 28 of the incision line 21.

The first connecting band 29 and the second connecting band 30 are joined to each other in the joining portion 8.

In other words, the first connecting band 29 and the second connecting band 30 are arranged in an inclined configuration relative to the retaining ring 5 and converge in the joining portion 8.

Continuing to unscrew the closure element 6, the latter is disengaged from the outer thread 17 made on the neck 18, so that the container can be opened. The retaining ring 5 remains, however, anchored to the neck 18. The first connecting band 29, the second connecting band 30 and the joining portion 8 define a hinge arrangement 40, shown in FIG. 3, about which the closure element 6 can rotate to allow the user to access the contents of the container.

In particular, by moving the closure element 6 about the hinge arrangement 40 after the closure element 6 has been disengaged from the neck 18, it is possible to move the closure element 6 to a lateral position relative to the neck 18, so that the closure element 6 is no longer coaxial with the retaining ring 5, as shown in FIG. 3. The closure element 6 may be rotated further backwards relative to the position shown in FIG. 3, in order to move it further away from the neck 18 and to allow the user to more easily access the contents of the container.

After use, the user can return the cap 1 to the closed position shown in FIG. 1 by a sequence of operations in reverse order compared with that previously described.

The first connecting band 29 and the second connecting band 30 allow a hinge arrangement 40 to be obtained which is longer than that which would be available if only one hinge band defined by the joining portion 8 were present. This makes it easier to disengage the closure element 6 from the neck 18, and reapply the closure element 6 on the neck 18, by rotating the closure element 6 about the hinge arrangement 40.

FIGS. 4 to 6 and 9 show a cap 201 according to another embodiment. The parts of the cap 201 common to the cap 1 described with reference to FIGS. 1 to 3 will be indicated with the reference numbers already used in FIGS. 1 to 3 and, for brevity, will not be described again in detail. What was previously described with reference to the cap 1 shall be understood to also be applicable to the cap 201, unless differences are explicitly provided. As shown in FIGS. 4 to 6 and 9, the cap 201 comprises the side wall 2 which extends about the axis Z, and the transversal wall 3 located at an end of the side wall 2, so as to close that end.

The cap 201 is further provided with the separation line 4, positioned on the side wall 2, which defines on the cap 201 the retaining ring 5 and the closure element 6. The retaining ring 5 is intended to remain anchored to the neck of the container on which the cap 201 is applied, owing to at least one engagement element provided inside it. In contrast, the closure element 6 is suitable for removably engaging with the neck, owing to the member for removably fixing provided inside the skirt 11. In this way, the closure element 6 is movable between a closed position, shown in FIGS. 4 and 5, and an open position, shown in FIG. 9.

The separation line of 4 extends about the axis Z and is circumferentially interrupted so as to define on the side wall 2 the joining portion 8 by which the closure element 6 is joined to the retaining ring 5.

The incision line 21 is furthermore provided on the side wall 2. In the example illustrated, the incision line 21 is axially interposed between the free edge 16 of the retaining ring 5 and the separation line 4.

The incision line 21 comprises a peripheral part 25, a further peripheral part 26 and a central part 24 interposed between the peripheral part 25 and the further peripheral part 26. The incision line 21 lies entirely in a plane positioned transversally, in particular perpendicularly, to the axis Z. In other words, the peripheral part 25, the central part 24 and the further peripheral part 26 are positioned in a common plane arranged transversally, in particular perpendicularly, to the axis Z.

Two connecting bands, that is to say, a connecting band 29 and a further connecting band 30, are defined between the separation line 4 and the incision line 21, the two connecting bands joining the retaining ring 5 to the joining portion 8.

In particular, the connecting band 29 extends between the peripheral part 25 of the incision line 21 and a portion of the separation line 4 which starts from the first end 9 of the later. Similarly, the further connecting band 30 extends between the further peripheral part 26 of the incision line 21 and a further portion of the separation line 4 which starts from the second end 10. The connecting band 29 and the further connecting band 30 may be arranged symmetrically to each other relative to a plane containing the axis Z and a centre line of the joining portion 8.

FIGS. 7 and 8 show a neck 218 on which the cap 201 may be applied. The neck 218 extends about a longitudinal axis Z1. When the cap 201 is applied on the neck 218 and the closure element 6 is in the closed position, the axis Z of the side wall 2 coincides with the longitudinal axis Z1.

The neck 218 is delimited by an outer surface 219, which in the example illustrated is cylindrical and coaxial with the longitudinal axis Z1.

The outer surface 219 extends as far as a rim 220 of the neck 218. The rim 220 surrounds an opening 221 through which it is possible to access the container, when the closure element 6 is in the open position. Vice versa, the closure element 6 closes the opening 221 when it is arranged in the closed position.

The neck 218 comprises a collar 222, suitable for preventing the retaining ring 5 from descending along the neck 218 below a predetermined level. Moreover, the collar 222 may be used for conveying the container during the production, filling and capping process.

The outer surface 219 extends from the collar 222 to the rim 220.

A circular enlargement 223 projects from the outer surface 219, the circular enlargement 223 being suitable for engaging with the engagement element provided inside the retaining ring 5 so as to prevent the retaining ring 5 from being detached from the neck 218.

The circular enlargement 223 may comprise a truncated cone shaped portion 224, whose diameter increases in a direction going from the rim 220 towards the collar 222.

The circular enlargement 223 is delimited, on the opposite side to the rim 220, by an abutment surface 225 against which the at least one engagement element of the retaining ring 5 abuts.

A cylindrical portion of the circular enlargement 223 may be interposed between the truncated cone shaped portion 224 and the abutment surface 225.

However, other geometries of the circular enlargement 223 are possible. The neck 218 comprises at least one element for removably fixing with which the member for removably fixing formed inside the closure element 6 can engage to allow the closure element 6 to be alternatively applied on, or removed from, the neck 218.

The at least one element for removably fixing may comprise an outer thread 217 formed on the outer surface 219, in particular projecting from the outer surface 219.

The cap 201 is intended to be applied on the neck 218 when the closure element 6 is in the closed position. In particular, the cap 201 is applied on the neck 218 in such a way that the at least one engagement element provided inside the retaining ring 5 is below the circular enlargement 223, in particular in a position interposed between the collar 222 and the circular enlargement 223.

When the user acts on the cap 201 to move the closure element 6 to the open position for the first time, the closure element 6 is unscrewed, that is to say, it is rotated about the longitudinal axis Z1 and simultaneously moved away from the collar 222. The retaining ring 5, joined to the closure element 6 by the breakable bridges 7, initially moves together with the closure element 6. When the at least one engagement element provided inside the retaining ring 5 abuts against the abutment surface 225, the retaining ring 5 cannot rise any further along the neck 218. On the other hand, the closure element 6 moves further away from the body of the container and simultaneously rotates about the longitudinal axis Z1, gradually as the user continues to unscrew the closure element 6. In this way, the breakable bridges 7 arranged along the separation line 4 are subjected to a stress that causes them to break. The connecting bands 29, 30 also deform while the closure element 6 is unscrewed. In particular, gradually as the closure element 6, during unscrewing, is moved away from the retaining ring 5, the connecting bands 29, 30 are positioned in an inclined position relative to the retaining ring 5, detaching from the retaining ring 5 along the incision line 21. The closure element 6 also detaches from the connecting bands 29, 30. Any breakable elements positioned along the incision line 21 break.

Figure 6:
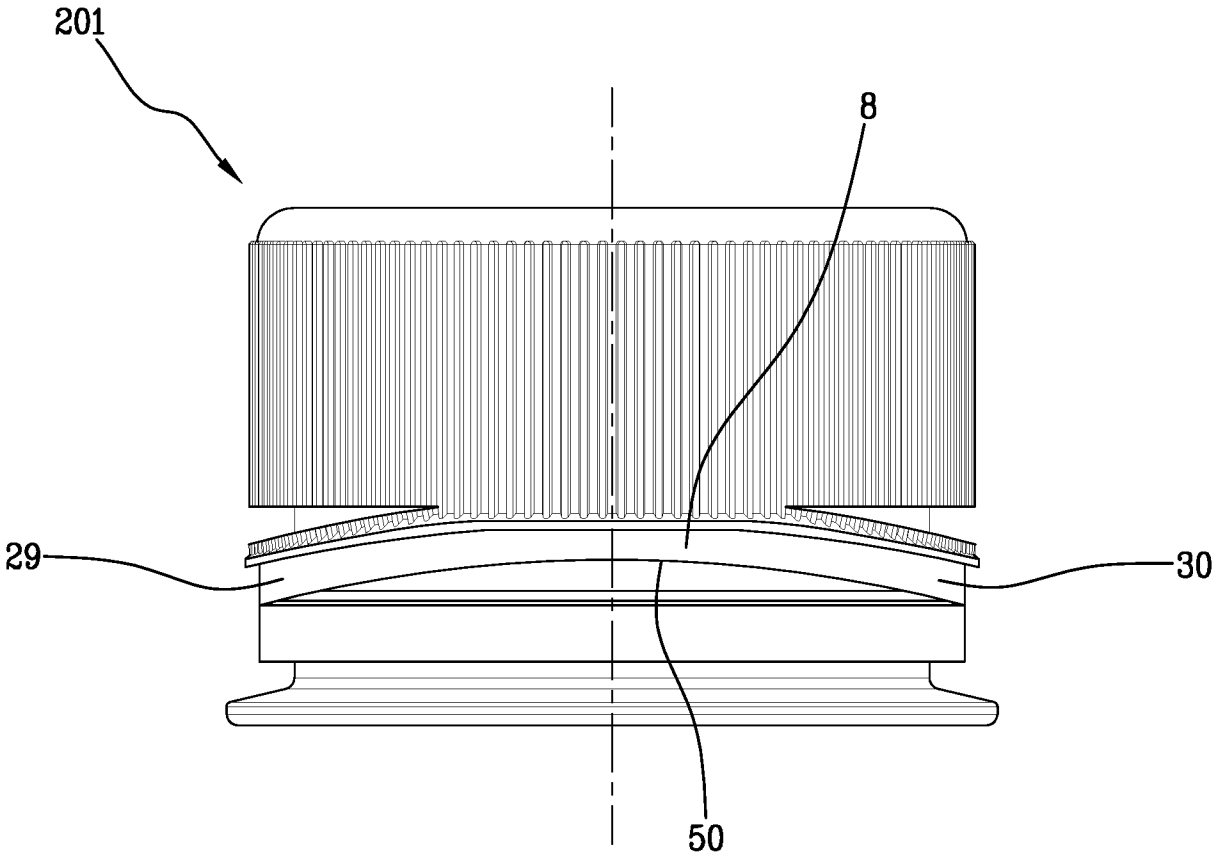
FIG. 6 is a side view like that of FIG. 4, in a configuration wherein a closure element of the cap is separated from a retaining ring.

In this way, the position shown in FIG. 6 is reached, wherein the neck has not been shown. The position shown in FIG. 6 may be defined as a disengaged position, because in the position shown in FIG. 6 the member for removably fixing formed inside the closure element 6 have disengaged from the thread 217 of the neck 218.

Figure 9:
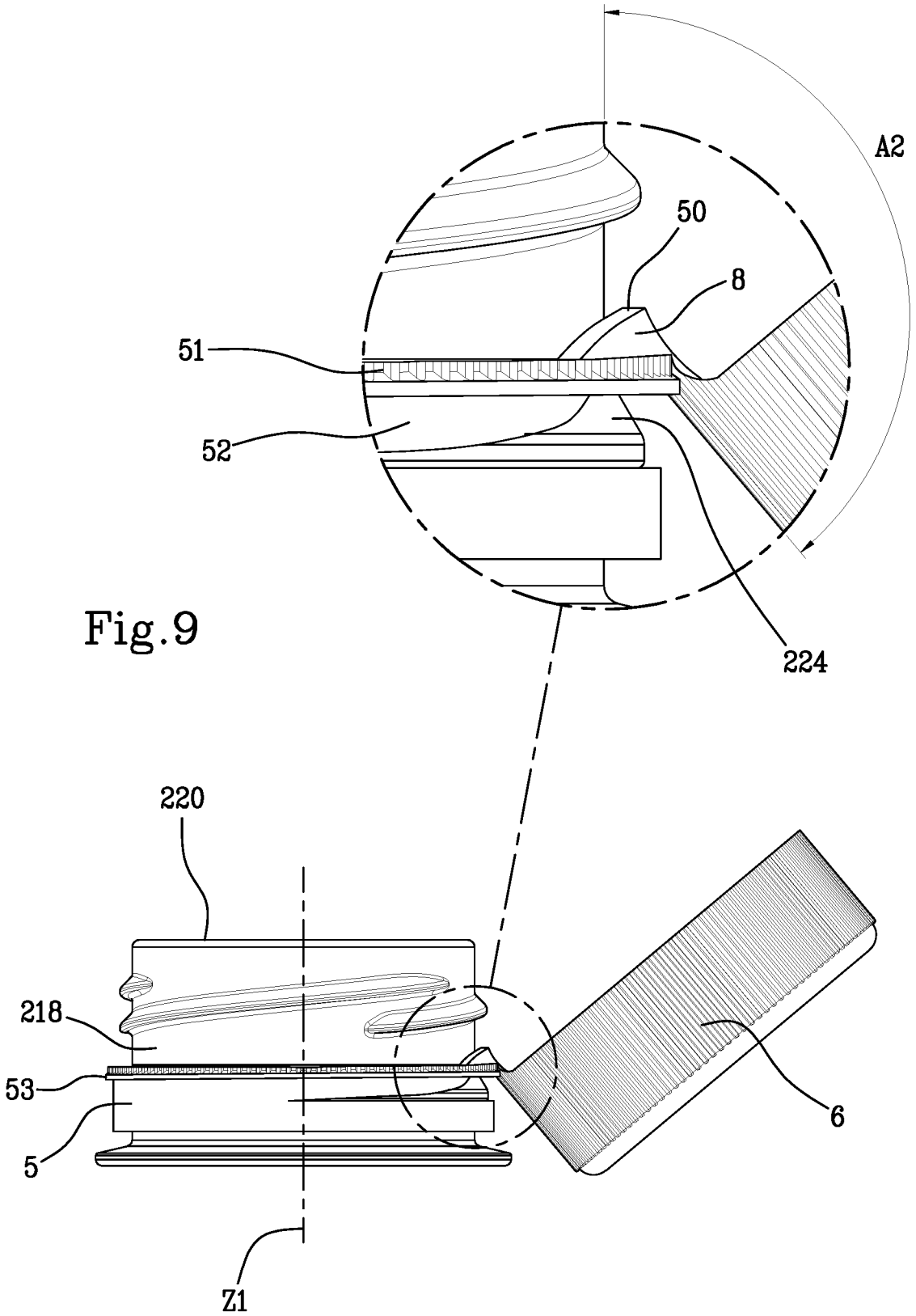
FIG. 9 is a side view, showing the cap of FIG. 4, applied on the neck of FIG. 7, the closure element of the cap being arranged in an open position.

At this point, the closure element 6 may be rotated relative to the retaining ring 5 for displacing it into the open position shown in FIG. 9, in which the closure element 6 is arranged on one side of the neck 218 and the axis Z of the closure element 6 no longer coincides with the longitudinal axis Z1 of the neck 218.

The connecting bands 29, 30 are deformable, in such a way that not just the closure element 6, but also the joining portion 8 is rotated relative to the neck 218.

As is shown more clearly in FIG. 6, the joining portion 8 is delimited by an edge 50 which, in the closed position of the closure element 6 (and in general before the closure element 6 is rotated relative to the retaining ring 5 to be moved to the open position) faces the retaining ring 5. More specifically, the edge 50 is defined on the side wall 2, towards the closure element 6, by the incision line 21.

When the closure element 6 passes from the disengaged position to the open position, the joining portion 8 is overturned relative to the neck 218. Consequently, the edge 50, which in the disengaged position (and also in the closed position) was facing the retaining ring 5, is positioned in such a way that it is facing towards the rim 220 of the neck 218, that is to say, upwards in the operative condition of FIG. 9.

In order to make that possible, the joining portion 8, and in particular its edge 50, slides along the truncated cone shaped portion 224 of the circular enlargement 223 and simultaneously rotates relative to the connecting bands 29, 30. The edge 50 reaches a height which is higher than the circular enlargement 223, assuming that the neck 218 is positioned in such a way that the opening 221 is facing upwards. The joining portion 8 is thus positioned at least partly above the circular enlargement 223, resting on the neck 218. In particular, the joining portion 8 rests on the outer surface 219 above the circular enlargement 223.

In this way, an interference is generated between the neck 218 and the joining portion 8, in particular along the edge 50 and near the latter. There may also be interference between the connecting bands 29, 30 and the neck 218. This allows the closure element 6 to be stably kept in the open position. In effect, in order to bring the closure element 6 back to the closed position, it is necessary to overcome the interference between the joining portion 8 and the neck 218. Normally, that does not occur accidentally, instead only occurring if the user deliberately applies sufficient force to the closure element 6, that is to say, if the user wishes to move the closure element 6 to the closed position.

Moreover, the interference which occurs between the joining portion 8 and the neck 218 makes it difficult for the cap 201 to be able to rotate about the neck 218, due to the rotation of the retaining ring 5 about the neck 218. In effect, the retaining ring 5 is connected to the joining portion 8 by the connecting bands 29, 30. Consequently, the retaining ring 5 is not free to rotate about the neck 218, instead it can only rotate if the interference between the joining portion 8 and the neck 218 is overcome.

In order to make it possible for the joining portion 8 to rotate when the closure element 6 passes from the disengaged position to the open position, the connecting bands 29, 30 are subjected to twisting, which affects at least part of the height H of each connecting band 29, 30. The term "height H" of the connecting bands 29, 30 refers to the dimension of the connecting bands 29, 30 in a direction parallel to the axis Z of the side wall 2, when the closure element 6 is in the closed position, as shown in FIG. 4.

In the example illustrated, wherein the separation line 4 and the incision line 21 lie in respective planes parallel to each other, the height H of the connecting bands 29, 30 is constant along the entire length of the connecting bands 29, 30 and is equal for the two connecting bands 29, 30. As shown in FIGS. 4 to 6 and 9, the knurling lines 13 are provided on the closure element 6. The knurling lines 13 may extend parallel to the axis Z. In the example illustrated, the separation line 4 intersects the knurling lines 13. In other words, the knurling lines 13 extend on both sides of, that is to say, both above and below, the separation line 4.

That occurs because the separation line 4 is provided in a position as close as possible to the member for removably fixing arranged inside the closure element 6, that is to say, to the inner thread. In this way, it is possible to increase the height H of the connecting bands 29, 30.

Consequently, as shown in FIG. 9, the connecting bands 29, 30 comprise a first portion 51 adjacent to the separation line 4, which in the example shown is provided with knurling lines 13 and a second portion 52 adjacent to the incision line 21, which in the example shown is smooth. A widened part 53 may be provided between the first portion 51 and the second portion 52.

In the example illustrated, when the joining portion 8 rotates so that the edge 50 is facing towards the rim 220, the second portion 52 of the connecting bands 29, 30 twists and passes under the first portion 51. The first portion 51, like the widened part 53, if present, in contrast expands radially, but does not undergo substantial twisting.

Owing to deformation of the connecting bands 29, 30, the joining portion 8 can rest on the neck 218 with the edge 50 facing towards the rim 220, without it being necessary to provide weakening lines or fracture lines in the joining portion 8 and/or in the connecting bands 29, 30. In this way, production of the cap 201 is not complicated.

In the closed position, when the edge 50 faces the retaining ring 5, there is an albeit small amount of play between the joining portion 8 and the neck 218. When the closure element 6 is moved to be brought to the open position, the joining portion 8 begins to rotate and starts to interfere with the neck 218. The interference between the joining portion 8 and the neck 218 reaches a maximum value when the joining portion 8 is approximately arranged in a plane perpendicular, or almost perpendicular, to the neck 218, or rather to its longitudinal axis Z1. The interference between the joining portion 8 and the neck 218 is reduced when the joining portion 8 is overturned, that is to say, when the edge 50 moves above the connecting bands 29, 30. In the open position, the interference between the joining portion 8 and the neck 218 remains, although it is less than the maximum value.

When the position in which the interference reaches a maximum value is passed, the user who is manually rotating the closure element 6 in order to move it to the open position can feel a sort of vibration. That vibration is perceived by the hand of the user, who is moving the closure element 6, as a discontinuity in the movement of the closure element 6. In other words, the closure element 6 snaps into place beyond the position in which the interference between the joining portion 8 and the neck 218 reaches the maximum value, and the user perceives this snap motion.

In this way the user is certain that the closure element 6 has been correctly moved to the open position.

It is also possible, but not necessary, for the vibration to be accompanied by a sound such as a "click", which can be heard by the user.

The cap 201 described above guarantees not just that the closure element 6 stably remains in the open position, but also that, in the open position, the closure element 6 is rotated backwards, relative to the neck, by a relatively wide opening angle A2, as shown in FIG. 9.

In particular, the angle A2 may be greater than, or equal to, 140°. This makes it very difficult for the closure element 6 to be able in an unwelcome way to strike the face of the user who is drinking directly from the bottle on which the cap 201 is applied, or for the closure element 6 to be able to obstruct the dispensing of a liquid contained in the bottle into a container, such as a glass.

Experimentation has shown that several geometric parameters of the cap 201 and/or of the neck 218 favour the behaviour previously described with reference to FIG. 9.

In particular, on the neck 218 it is possible to define an external or maximum diameter Dmax of the circular enlargement 223, as shown in FIG. 7. It is also possible to define a diameter Ds of the outer surface 219 of the neck 218, immediately above the circular enlargement 223, that is to say, in a position interposed between the circular enlargement 223 and the outer thread 217. In the example illustrated, the diameter Ds immediately above the circular enlargement 223 coincides with the diameter of the outer surface 219 in a region interposed between the outer thread 217 and the rim 220, but this condition is not necessary.

Delta indicates the difference between the external diameter Dmax of the circular enlargement 223 and the diameter Ds of the outer surface 219 immediately above the circular enlargement 223.

In the example illustrated, the external diameter Dmax of the circular enlargement 223 is 30.2 mm.

The diameter Ds of the outer surface 219 immediately above the circular enlargement 223 is 28 mm.

The difference Delta between Dmax and Ds is 30.2−28=2.2 mm.

Half of the difference Delta expresses how far the circular enlargement 223 projects relative to the outer surface 219.

As already said, H indicates the height of the connecting bands 29, 30, that is to say, the distance between the separation line 4 and the incision line 21, measured parallel to the axis Z, when the closure element 6 is in the closed position.

In the example illustrated, the height H is 2.8 mm.

The ratio R1 between the height H and half of the difference Delta is therefore 2.8/1.1, that is to say, 2.55.

It is advisable for the ratio R1 between the height H and half of the difference Delta, as they are defined above, to be greater than, or equal to 1.5. It is preferable for the above-mentioned ratio R1 to be greater than, or equal to, 2. It is even more preferable for R1 to be greater than, or equal to, 2.5.

That ensures that the height H of the connecting bands 29, 30 is correctly proportionate to how far the circular enlargement 223 projects from the outer surface 219.

More specifically, if the ratio R1 is less than 1.5, it may happen that between the joining portion 8 and the neck 218 the interference created is not sufficient to stably lock the closure element 6 in an open position in which the opening angle A2 is greater than, or equal to, 120°, preferably greater than, or equal to, 140°.

In certain cases, a value of the ratio R1 less than 1.5 can be accepted, but not less than 0.8.

In the example illustrated, half of the difference Delta between the external diameter Dmax of the circular enlargement 223 and the diameter Ds of the outer surface 219 of the neck 218, immediately above the circular enlargement 223, is Delta/2=1.1 mm.

It is possible to obtain a cap 201 which works correctly even with values of the difference Delta other than those mentioned above. In general, experimentation has shown that relatively low values of the difference Delta (and therefore of Delta/2) are helpful for obtaining a behaviour of the type shown in FIG. 9.

The joining portion 8 has an angular dimension W about the axis Z of the side wall, which has been explicitly indicated in FIG. 1 and which is definable in the same way with reference to the cap 201.

In the example illustrated, the angular dimension W of the joining portion 8 is 54°.

In general, the angular dimension W may be greater than, or equal to, 20°, preferably greater than, or equal to, 25°.

Moreover, the angular dimension W may be less than, or equal to, 120°, preferably less than, or equal to, 90°.

In an embodiment, the angular dimension W may be between 80° and 120°.

In an embodiment, the angular dimension W of the joining portion 9 may range from 30* to 110*. It may for example be 60°.

Experimentation has shown that, if the angular dimension W is greater than 120°, the connecting bands 29, 30 may break, when the closure element 6 is rotated in order to move it to the open position.

In contrast, if W is less than 20°, it may happen that the joining portion 8 does not succeed in stably keeping the closure element 6 in an open position in which the opening angle A2 is greater than, or equal to, 120°, preferably greater than, or equal to, 140°.

It is also possible to define a distance Y, shown in FIG. 7, between the circular enlargement 223 and the at least one element for removably fixing provided on the neck 219. In other words, the distance Y is measured between the upper limit of the circular enlargement 223 and the starting point of the outer thread 217.

The distance Y may be greater than, or equal to, half of the distance between the separation line 4 and the incision line 21, that is to say, half the height H. However, this condition is not necessary.

It is possible to define an angle A, indicated in FIG. 7, formed between a generatrix of the truncated cone shaped portion 224 and a straight line parallel to the longitudinal axis Z1.

In the example illustrated, the angle A is 30°.

More generally, the angle A is preferably less than, or equal to, 35°.

That reduces the risk of the joining portion 8 not sliding correctly on the circular enlargement 223, in particular near the external diameter Dmax, for then stably stopping in contact with the neck 218.

When the user wishes to reclose the container, the closure element 6 can be returned to the closed position with a sequence of operations in reverse order compared with that previously described. In particular, the user rotates the closure element 6 relative to the neck 218 in order to return it to the closed position. Consequently, the joining portion 8 is also rotated, so as to return the edge 50 below the connecting bands 29, 30, in a position facing the retaining ring 5. When the edge 50 disengages from the neck 218, the user perceives a vibration or snap-motion feedback, which may (but not necessarily) be accompanied by a "click" sound. In this way, the user realises that the closure element 6 is ready to be screwed onto the neck 218 again. In effect, the disengagement position has been reached, starting from which the closure element 6 can be screwed onto the neck 218 again for moving it to the closed position.

In the example of FIG. 9, in the open position, the edge 50 lies in a plane substantially perpendicular to the longitudinal axis Z1 of the neck 218, that is to say, in a horizontal plane. However, this condition is not necessary.

As shown in FIG. 10, in the open position, the edge 50 could also lie on a plane inclined towards the outer surface 219 of the neck 218, on the side of the rim 22.

In the open position, the edge 50 could also adopt a configuration similar to that of FIG. 10, but not flat.

Also in the case shown in FIG. 10, the behaviour of the cap is similar to that described above with reference to FIGS. 4 to 6 and 9. What has been described with reference to FIGS. 4 to 6 and 9 is therefore to be considered also applicable to FIG. 10.

In the example described so far with reference to FIGS. 4 to 6 and 9, the separation line 4 is located in a portion of the side wall 2 wherein the knurling lines 13 are present.

However, this condition is not necessary. In an alternative embodiment not illustrated, the separation line 4 may be made in a portion of the side wall 2 wherein the latter is externally delimited by a substantially smooth outer surface. That is to say, the separation line 4 may be positioned in a portion of the side wall 2 free of knurling lines 13, for example interposed between the knurling lines 13 and the free edge 16. Consequently, in the alternative embodiment just described, the connecting bands 29, 30 are externally delimited by a smooth surface, that is to say, a surface free of knurling lines. An example of a cap of this type is shown in FIG. 11.

FIG. 11 shows a cap 301 in which the side wall 2 has, on an outer surface thereof, a plurality of knurling lines 13.

In the example of FIG. 11, the separation line 4 is provided in a portion of the side wall 2 without knurling lines 13, that is to say, in a smooth portion of the side wall 2. This occurs because the knurling lines 13 have respective lower ends (that is to say, closer to the free edge 16) which are spaced from the separation line 4. The separation line 4 is therefore provided in a non-knurled portion of the side wall 2.

The breakable bridges 7 arranged along the separation line 4 are visible in the example of FIG. 11. Some breakable elements 70 arranged along the incision line 21 are also visible. The breakable elements 70 may be similar to the breakable bridges 7.

In the example shown, the breakable elements 70 are offset relative to the breakable bridges 7, in a direction parallel to the axis Z of the cap 301. In other words, a plane which contains the axis Z and passes through a breakable bridge 7 does not intersect any breakable element 70.

In other words, the breakable elements 70 are arranged in positions angularly offset about the axis Z relative to the breakable bridges 7.

Each breakable bridge 7 and each breakable element 70 may have a width, measured in a circumferential direction, respectively, along the separation line 4 and along the incision line 21, equal to 0.4 mm.

The cap 301 shown in FIG. 11 has, during opening and closing, a behaviour similar to that of the cap 201 shown in FIGS. 4 to 6 and 9. More specifically, when the closure element 6 of the cap 301 is moved from the closed position to the open position, the connecting bands 29, 30 deform with a twisting movement which may affect a part of their height, similarly to what is shown in FIGS. 9 and 10 for the cap 201. In the example of FIG. 11, the first portion 51 adjacent to the separation line 4 and the second portion 52 adjacent to the incision line 21 are both smooth, that is to say, without knurling lines.

The connecting bands 29, 30 shown in FIG. 11 can be deformed in such a way that the first portion 51 expands radially, without undergoing a substantial twisting. The second portion 52, on the other hand, may twist to pass under the first portion 51, so as to be interposed between the first portion 51 and the outer surface 219 of the neck 218. In this way, the edge 50 may pass beyond the circular enlargement 223 and be positioned at a height higher than the latter, that is to say, closer to the rim 220 than the circular enlargement 223.

This allows the joining portion 8 to rotate relative to the connecting bands 29, 30, thereby passing above, that is to say, at a higher height, of the circular enlargement 223 and resting on the outer surface 219.

As shown in FIG. 11, the separation line 4 is positioned at a distance D1 from the free edge 16 of the retaining ring 5.

The distance D1 is less than, or equal to, 6.5 mm. Preferably, the distance D1 is less than, or equal to, 5 mm.

The distance D1 is greater than, or equal, to 2 mm. Preferably, the distance D1 is greater than, or equal to, 3 mm.

In a preferred embodiment, the distance D1 is thus between 3 and 5 mm. The separation line 4 may have an angular extension, about the axis Z, greater than, or equal to, 250°. The angular extension of the separation line 4 may be less than, or equal to, 330°.

In an embodiment, the angular extension of the separation line 4 may be between 250° and 280°.

The incision line 21 is positioned at a distance D2 from the free edge 16 of the retaining ring 5.

The distance D2 may be greater than, or equal to, 1 mm.

The distance D2 may be less than, or equal to, 5 mm. More specifically, the distance D2 may be less than, or equal to, 4 mm.

In an embodiment, the distance D2 may be between 1 and 3 mm.

In an embodiment, the distance D2 may be equal to 3.9 mm.

The incision line 21 may have an angular extension about the axis Z greater than, or equal to, 120°. This angular extension may be less than, or equal to, 250°.

In an embodiment, the incision line 21 may have an angular extension greater than, or equal to, 130°.

The angular extension of the incision line 21 may be less than, or equal to, 200°.

The angular extension of the incision line 21 may be, for example, equal to 160°.

In an embodiment, the angular extension of the incision line 21 may be between 180° and 250°.

The connecting bands 29, 30 may have a height H greater than, or equal to, 1 mm and less than, or equal to, 5.5 mm.

The height H is measured parallel to the axis Z, in the closed position of the cap 1.

More specifically, the connecting bands 29, 30 may have a height H greater than, or equal to, 1.2 mm and less than, or equal to, 4 mm.

In an embodiment, the height H ranges from 1.2 mm to 3.5 mm.

The height H may be equal to 2 mm.

In an embodiment, the cap 301 may have a height H1, measured in a direction parallel to the axis Z, between 10 and 21 mm.

Figure 12:
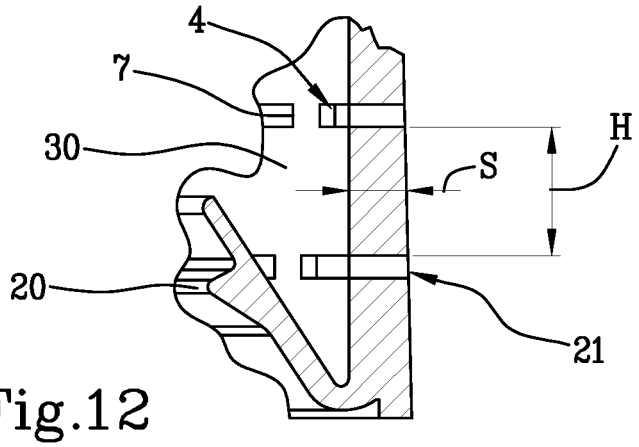
FIG. 12 is a cross section of an enlarged detail of the cap of FIG. 11.

As shown in FIG. 12, each connecting band 29, 30 may have a radial thickness S, that is to say, a thickness measured in a radial direction relative to the axis Z, greater than, or equal to, 0.35 mm. This thickness may be less than, or equal to, 1.8 mm.

In an embodiment, the radial thickness S of each connecting band 29, 30 may be greater than, or equal to, 0.5 mm. This thickness may be less than, or equal to, 1.2 mm.

The radial thickness S of the connecting bands 29, 30 may be constant in a direction parallel to the axis Z. Alternatively, the radial thickness S of the connecting bands 29, 30 may be variable in a direction parallel to the axis Z. More specifically, the radial thickness S of the connecting bands 29, 30 may vary along a direction parallel to the axis Z, in such a way as to remain inside the ranges indicated above.

In an embodiment, relatively large radial thicknesses S of the connecting bands 29, 30 correspond to a relatively small height H, and vice versa.

For example, if the radial thickness S is in the upper half of the range 0.35-1.8 mm, that is to say, in the range 1.1-1.8 mm, the height H may be in the lower half of the range 1-5.5 mm, that is to say, in the range 1-3.2 mm.

The opposite also applies, that is to say, if the radial thickness S is variable in the range of 0.35-1.1 mm, the height H may be variable in the range 3.2-5.5 mm. It is, however, also possible to combine relatively large radial thicknesses S of the connecting bands 29, 30 with a relatively large height H.

Below are some examples of dimensions which caps of the type shown in FIG. 11 may have.

| Type of cap/neck | S [mm] | H [mm] | H/S |
|---|---|---|---|
| 29/25 mm | 0.7 | 1.2 | 1.71 |
| 29/25 mm | 0.7 | 2.3 | 3.29 |
| PCO 1881 | 0.75 | 3.5 | 4.67 |
| 30/25 mm | 0.65 | 2.7 | 4.15 |
| 30/25 mm | 0.45 | 2.45 | 5.44 |
| 38 mm 3 threads | 0.7 | 3.1 | 4.43 |
| 29/25 mm | 0.85 | 1.2 | 1.4 |
| 30/25 mm | 0.55 | 2.8 | 5.1 |

It has been found experimentally that these caps remain stably open with an opening angle A2 of at least 120°.

The ratio between the height H of the connecting bands (that is to say, the distance between the separation line 4 and the incision line 21) and the radial thickness S of the connecting bands may be greater than, or equal to, 1.4.

The above-mentioned ratio may be less than, or equal to, 5.1.

More generally speaking, the ratio between the height H of the connecting bands and the radial thickness R of the connecting bands may be less than, or equal to, 6.5.

These values ensure that the connecting bands 29, 30 have an optimum torsional rigidity to deform as described above and to generate an interference between the neck and the joining portion 8 (and possibly between the neck the connecting bands 29, 30) sufficient to keep the closure element 6 in the open position in a reliable and secure manner.

The numerical values defined above with reference to the cap 301 shown in FIG. 11 are also applicable to the cap 201 shown in FIGS. 4 to 6, 9 and 10.

The cap 201 or 301 is also particularly easy to make.

In effect, the cap 201 or 301 may be obtained starting from a concave body comprising the side wall 2 and the transversal wall 3. The concave body is produced by moulding a polymeric material, for example compression moulding or injection moulding.

After the concave body has been formed, the separation line 4 and the incision line 21 are made on the side wall 2.

The separation line 4 and the incision line 21 may be made by cutting operations, for example performed in a cutting unit located downstream of a mould in which the concave body has been formed. Such cutting operations may be performed by respective blades, for example circular or linear, which interact with the side wall 2 from the outside of the latter, or from the inside. In particular, the concave body may be rotated about the axis Z of the side wall 2, while the blades are held in their position, so as to bring consecutive zones of the side wall 2 to interact, one after another, with the blades. It is also possible to hold the concave body in its position and to rotate the blades, for making the cut.

The blades which allow the separation line 4 and the incision line 21 to be obtained may be configured to interact with the side wall 2 in respective parallel planes, for example perpendicular to the axis Z, if, as in the examples shown so far, the separation line 4 and the incision line 21 are to lie in respective parallel planes.

The blades may have an interrupted cutting edge, if, along the separation line 4 the breakable bridges 7 are to remain defined and/or if, along the incision line 21, respective breakable elements are to remain defined.

The incision line 21 may be made by using a blade having a flat cutting edge, so that the incision line 21 lies in a plane for the whole length of the incision line 21.

It is also possible that the blades do not cut through the entire thickness of the side wall 2, instead only partially cutting through thickness of the side wall 2, so as to leave, along the incision line 21 and/or along the separation line 4, a thin membrane intended to be broken the first time the cap is opened.

The separation line 4 and the incision line 21 may be made simultaneously, or during two separate steps.

The cap 201 or 301 is therefore particularly easy to produce, since the concave body can be formed in an ordinary mould. There is no need for undercut parts or thin parts other than those normally provided for a cap of the known type.

An additional operation, that is to say, making the incision line 21, may be performed very simply while the separation line 4 is obtained.

Geometries of the incision line different from those that have been shown so far are possible.

Figure 13:
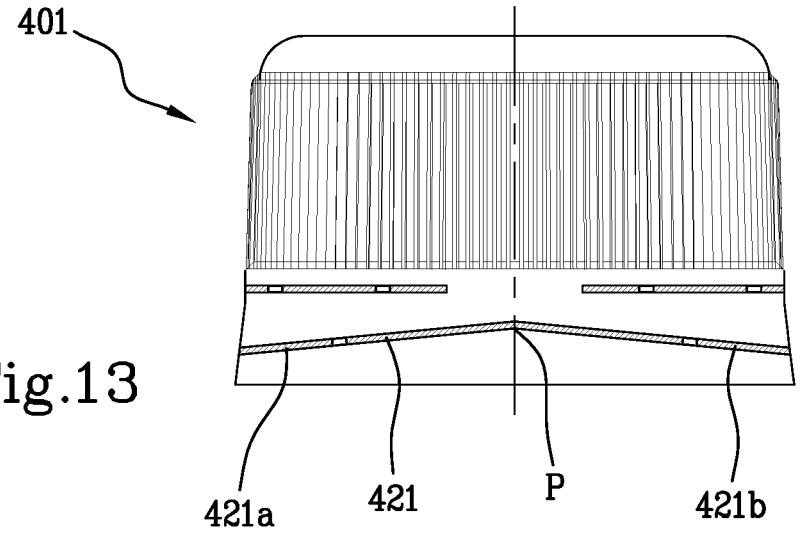
FIG. 13 is a view like that of FIG. 4, showing a cap according to a further alternative embodiment.

For example, FIG. 13 shows a cap 401 according to an alternative embodiment, which differs from that shown in FIG. 11 because it comprises an incision line 421 which does not lie in a single plane, but is defined by two curved stretches 421*a* and 421*b* which lie in respective planes converging in a common line. That is to say, the curved stretches 421*a*, 421*b* converge at a point P which, in the example of FIG. 13, is positioned higher than the remaining extension of the curved stretches 421*a*, 421*b*.

Figure 15:
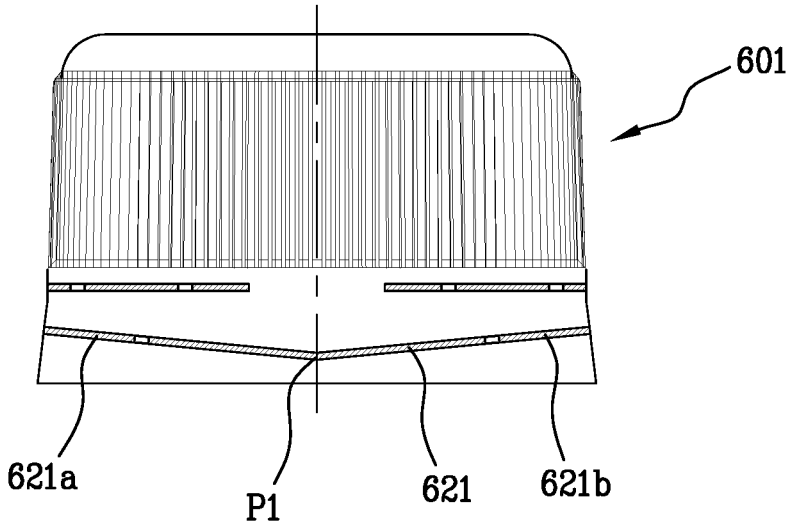
FIG. 15 is a view like that of FIG. 4, showing a cap according to another alternative embodiment.

The example of FIG. 15 shows, on the other hand, a cap 601 the incision line 621 of which is defined by two curved stretches 621*a*, 621*b* which converge at a point P1 positioned lower than the remaining extension of the curved stretches 621*a*, 621*b*.

Figure 14:
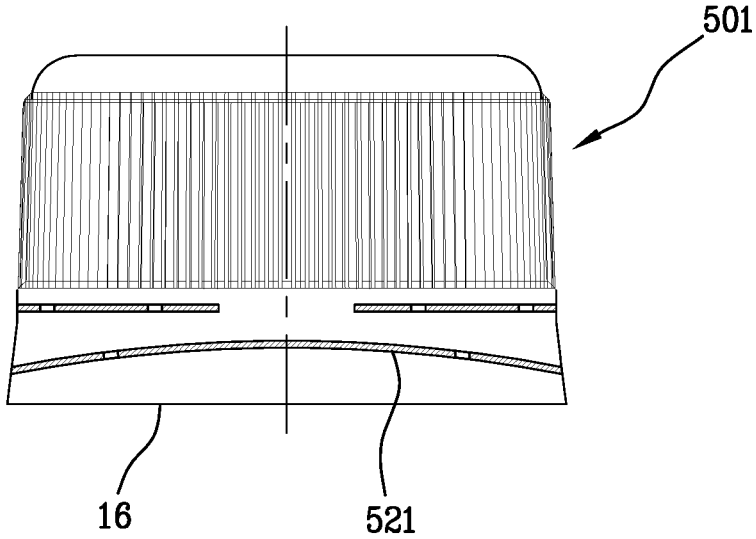
FIG. 14 is a view like that of FIG. 4, showing a cap according to another alternative embodiment.

In the example of FIG. 14, on the other hand, there is provided a cap 501 having an incision line 521 which is not flat, but which has a curved trend on the side wall of the cap, with concavity facing downwards, that is, towards the free edge 16 of the retaining ring 5.

Figure 16:
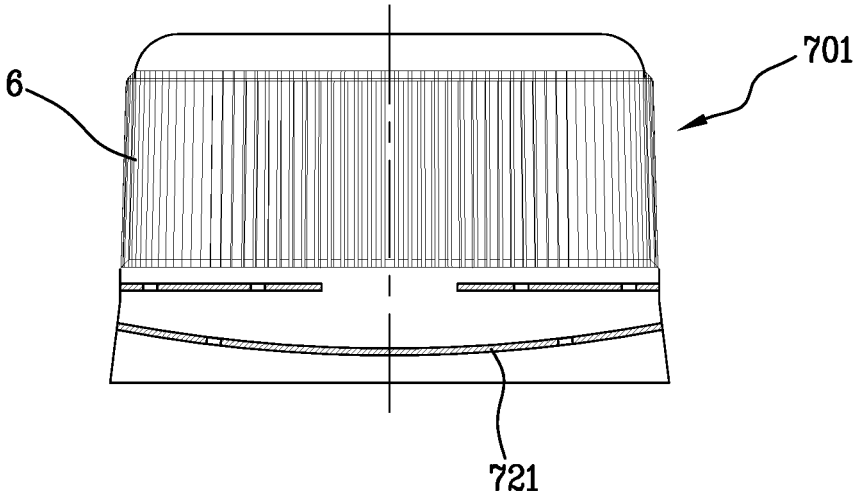
FIG. 16 is a view like that of FIG. 4, showing a cap according to another alternative embodiment.

Lastly, FIG. 16 shows a cap 701 the incision line 721 of which has a curved shape with concavity facing upwards, that is to say, towards the closure element 6.

The caps described above are made of plastics, for example polypropylene (PP) or polyethylene (PE).

If PE is used, its density may range from low density to high density. More specifically, it is possible to use high-density polyethylene (HDPE).

The high-density polyethylene (HDPE) used to produce the caps described above can have the following properties:

- a density variable between 950 and 968 kg/m$^3$;
- melt index variable from 0.3 to 20 g, under the following measurement conditions: 10 minutes, 190° C., 2.16 kg;
- large, or narrow, or unimodal, or multi-modal distribution of molecular weight.

If PP is used, the material may be in the form of a homopolymer, or heterophasic copolymer, or statistical copolymer.

The melt index of the PP may vary from 2 to 20 g, under the following measurement conditions: 10 minutes, 230° C., 2.16 kg.

The invention claimed is:

1. A cap for a container, comprising a side wall extending about an axis and a transversal wall arranged at an end of the side wall, a separation line being provided on the side wall for defining:

- a retaining ring intended to remain anchored to a neck of the container, and
- a closure element which can removably engage the neck, so as to open or close the container;

wherein the separation line extends about the axis and is circumferentially interrupted so as to leave a joining portion between the retaining ring and the closure element, the cap further having an incision line which extends transversally to the axis between the separation line and a free edge of the retaining ring, so that two connecting bands are defined between the separation line and the incision line, the connecting bands joining the retaining ring to the joining portion, the connecting bands having a radial thickness measured in a radial direction, the connecting bands further having a height measured parallel to the axis, and wherein the ratio between the height and the radial thickness of the connecting bands is greater than, or equal to, 1.4, said ratio being less than, or equal to, 6.5.

2. A cap according to claim 1, wherein the height of the connecting bands is greater than, or equal to, 1 mm and is less than, or equal to, 5.5 mm.

3. A cap according to claim 1, wherein the radial thickness of the connecting bands is greater than, or equal to, 0.35 mm and is less than, or equal to, 1.8 mm.

4. A cap according to claim 1, wherein the radial thickness is greater than, or equal to, 1.1 mm and less than, or equal to, 1.8 mm, the height being greater than, or equal to, 1 mm and less than, or equal to, 3.2 mm.

5. A cap according to claim 1, wherein the radial thickness is greater than, or equal to, 0.35 mm and less than, or equal to, 1.1 mm, the height being greater than, or equal to, 3.2 mm and less than, or equal to, 5.5 mm.

6. A cap according to claim 1, wherein the separation line and the incision line are cut lines.

7. A cap according to claim 1, wherein along the separation line a plurality of breakable bridges is provided, along the incision line a plurality of breakable elements being provided, the breakable bridges and the breakable elements being intended to break the first time the cap is opened.

8. A cap according to claim 7, wherein the breakable elements are arranged in positions angularly offset about the axis relative to the breakable bridges.

9. A cap according to claim 1, wherein the incision line lies in a plane arranged perpendicularly to said axis, when the closure element is in a closed position.

10. A cap according to claim 1, wherein the joining portion has an angular dimension, measured about the axis, greater than, or equal to, 30° and less than, or equal to, 110°.

11. A cap according to claim 1, wherein the incision line has an angular extension, measured about the axis, greater than, or equal to, 120° and less than, or equal to, 250°.

12. A cap according to claim 1, wherein the separation line is positioned at a distance from the free edge of the retaining ring which is greater than, or equal to, 2 mm and less than, or equal to, 6.5 mm.

13. A cap according to claim 1, wherein the incision line is arranged at a distance from the free edge of the retaining ring which is greater than, or equal to, 1 mm and less than or equal to, 5 mm.

* * * * *